US009211514B2

(12) United States Patent
Hughes et al.

(10) Patent No.: US 9,211,514 B2
(45) **Date of Patent: *Dec. 15, 2015**

(54) METHOD AND APPARATUS FOR PRODUCING PAINT

(71) Applicant: MicroBlend Technologies, Inc., Gilbert, AZ (US)

(72) Inventors: Randall L Hughes, Glendale, AZ (US); Kevin A. Newell, Gold Canyon, AZ (US); Michael Mowen, Gilbert, AZ (US)

(73) Assignee: MicroBlend Technologies, Inc., Gilbert, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/598,826

(22) Filed: Jan. 16, 2015

(65) Prior Publication Data

US 2015/0124553 A1 May 7, 2015

Related U.S. Application Data

(63) Continuation of application No. 13/328,719, filed on Dec. 16, 2011, now Pat. No. 8,936,390.

(51) Int. Cl.

| | |
|---|---|
| ***B01F 15/02*** | (2006.01) |
| ***B01F 15/04*** | (2006.01) |
| ***B01F 13/10*** | (2006.01) |
| ***B08B 3/02*** | (2006.01) |
| ***B01F 3/08*** | (2006.01) |
| *B01F 15/00* | (2006.01) |

(52) U.S. Cl.

CPC ..... *B01F 15/0416* (2013.01); *B01F 3/0803* (2013.01); *B01F 3/088* (2013.01); *B01F 13/1063* (2013.01); *B01F 15/00064* (2013.01); *B08B 3/02* (2013.01); *B01F 15/00032* (2013.01); *B01F 2215/005* (2013.01)

(58) Field of Classification Search

CPC .. B08B 3/02; B01F 13/1063; B01F 15/00032

USPC ..... 366/152.1, 152.2, 160.1, 160.2, 160.5, 366/162.1, 177.1, 181.6, 605; 222/94, 132, 222/168, 168.5, 135, 137, 144, 144.5; 141/144–146, 104; 700/239

See application file for complete search history.

(56) References Cited

U.S. PATENT DOCUMENTS

| | | | | |
|---|---|---|---|---|
| 4,403,866 | A * | 9/1983 | Falcoff et al. | 366/132 |
| 4,676,286 | A * | 6/1987 | Aiuola et al. | 141/145 |
| 4,681,741 | A * | 7/1987 | Hanaway | 422/509 |

(Continued)

FOREIGN PATENT DOCUMENTS

WO 2013/090763 A1 * 6/2013

*Primary Examiner* — Charles Cooley

(74) *Attorney, Agent, or Firm* — Schmeiser, Olsen & Watts LLP

(57) ABSTRACT

The present invention is directed to a method and apparatus for producing an aqueous paint from a plurality of premixed compositions at the point of sale wherein the apparatus is cleaned during the paint production. The premixed compositions include a pigment composition, a dispersant-thickening agent composition, a high resin content binder, and a low resin content binder. The dispersant-thickening agent, when supplied in a cleaning amount, effectively cleans the nozzles and valves, used to supply the premixed compositions to a receiving reservoir for the desired aqueous paint.

13 Claims, 12 Drawing Sheets

(56) References Cited

U.S. PATENT DOCUMENTS

| | | | | |
|---|---|---|---|---|
| 4,967,938 | A * | 11/1990 | Hellenberg | 222/144 |
| 5,078,302 | A * | 1/1992 | Hellenberg | 222/144 |
| 5,083,591 | A * | 1/1992 | Edwards et al. | 141/9 |
| 5,116,134 | A * | 5/1992 | Edwards et al. | 366/208 |
| 5,119,973 | A * | 6/1992 | Miller et al. | 222/144 |
| 5,137,367 | A * | 8/1992 | Madonia et al. | 366/218 |
| 5,163,484 | A * | 11/1992 | Howlett et al. | 141/9 |
| 5,203,387 | A * | 4/1993 | Howlett et al. | 141/103 |
| 5,445,195 | A * | 8/1995 | Kim | 141/104 |
| 5,474,211 | A * | 12/1995 | Hellenberg | 222/1 |
| 5,493,840 | A * | 2/1996 | Cane | 53/50 |
| 5,842,641 | A * | 12/1998 | Mazzalveri | 239/104 |
| 5,938,080 | A * | 8/1999 | Haaser et al. | 222/144 |
| 6,203,183 | B1 * | 3/2001 | Mordaunt et al. | 366/138 |
| 6,494,608 | B1 * | 12/2002 | Retamal et al. | 366/132 |
| 6,793,387 | B1 * | 9/2004 | Neas et al. | 366/160.4 |
| 6,917,424 | B2 * | 7/2005 | Rodrigues et al. | 356/326 |
| 6,969,190 | B1 * | 11/2005 | McClain et al. | 366/141 |
| 7,065,429 | B1 * | 6/2006 | McClain et al. | 700/239 |
| 7,121,430 | B2 * | 10/2006 | Mink et al. | 222/135 |
| 7,132,470 | B2 * | 11/2006 | McClain et al. | 524/497 |
| 7,250,464 | B2 * | 7/2007 | Friel et al. | 524/497 |
| 7,264,160 | B2 * | 9/2007 | Polarine et al. | 235/385 |
| 7,264,161 | B2 * | 9/2007 | Polarine | 235/385 |
| 7,339,000 | B1 * | 3/2008 | McClain et al. | 524/495 |
| 7,612,129 | B2 * | 11/2009 | Friel et al. | 523/351 |
| 7,619,023 | B2 * | 11/2009 | McClain et al. | 524/417 |
| 7,654,416 | B2 * | 2/2010 | Buining et al. | 222/144 |
| 7,654,727 | B2 * | 2/2010 | McClain et al. | 366/141 |
| 7,698,021 | B2 * | 4/2010 | Hughes et al. | 700/285 |
| 7,815,361 | B2 * | 10/2010 | Lindblom | 366/136 |
| 7,865,264 | B2 * | 1/2011 | Hughes et al. | 700/239 |
| 7,890,213 | B2 * | 2/2011 | Greco et al. | 700/265 |
| 7,919,546 | B2 * | 4/2011 | Trevino et al. | 523/318 |
| 7,939,593 | B2 * | 5/2011 | McClain et al. | 524/417 |
| 7,942,569 | B2 * | 5/2011 | Orben et al. | 366/141 |
| 7,951,855 | B2 * | 5/2011 | Trevino et al. | 523/318 |
| 8,014,885 | B2 * | 9/2011 | Hughes et al. | 700/97 |
| 8,042,578 | B2 * | 10/2011 | Post et al. | 141/83 |
| 8,386,072 | B1 * | 2/2013 | Mihalik et al. | 700/233 |
| 8,567,643 | B2 * | 10/2013 | Solera et al. | 222/144 |
| 8,622,248 | B2 * | 1/2014 | Sacchet | 222/144.5 |
| 8,936,390 | B2 * | 1/2015 | Hughes et al. | 366/162.1 |
| 2003/0110101 | A1 * | 6/2003 | Friel et al. | 705/28 |
| 2004/0059041 | A1 * | 3/2004 | McClain et al. | 524/497 |
| 2004/0149776 | A1 * | 8/2004 | Feygin et al. | 222/144 |
| 2004/0159676 | A1 * | 8/2004 | Adema | 222/144 |
| 2004/0262330 | A1 * | 12/2004 | Voskuil et al. | 222/144 |
| 2005/0038557 | A1 * | 2/2005 | Friel et al. | 700/233 |
| 2005/0092772 | A1 * | 5/2005 | Miller et al. | 222/135 |
| 2005/0194403 | A1 * | 9/2005 | Mink et al. | 222/135 |
| 2006/0148967 | A1 * | 7/2006 | McClain et al. | 524/497 |
| 2006/0169718 | A1 * | 8/2006 | Buining et al. | 222/144 |
| 2006/0175571 | A1 * | 8/2006 | Held et al. | 251/315.03 |
| 2006/0261089 | A1 * | 11/2006 | Mink et al. | 222/144 |
| 2006/0278663 | A1 * | 12/2006 | Mink et al. | 222/372 |
| 2007/0044863 | A1 * | 3/2007 | Engels et al. | 141/83 |
| 2007/0253280 | A1 * | 11/2007 | Orben et al. | 366/141 |
| 2008/0051936 | A1 * | 2/2008 | Lindblom | 700/239 |
| 2008/0146699 | A1 * | 6/2008 | McClain et al. | 523/351 |
| 2008/0195250 | A1 * | 8/2008 | Post et al. | 700/233 |
| 2008/0257220 | A1 * | 10/2008 | McClain et al. | 106/501.1 |
| 2008/0300714 | A1 * | 12/2008 | Hughes et al. | 700/117 |
| 2008/0305241 | A1 * | 12/2008 | Trevino et al. | 427/1 |
| 2009/0099695 | A1 * | 4/2009 | Trevino et al. | 700/265 |
| 2009/0112371 | A1 * | 4/2009 | Hughes et al. | 700/282 |
| 2009/0228143 | A1 * | 9/2009 | Hughes et al. | 700/239 |
| 2009/0228367 | A1 * | 9/2009 | Hughes et al. | 705/26 |
| 2009/0236367 | A1 * | 9/2009 | Voskuil et al. | 222/144 |
| 2009/0276091 | A1 * | 11/2009 | Duha et al. | 700/239 |
| 2010/0023462 | A1 * | 1/2010 | McClain et al. | 705/500 |
| 2011/0313557 | A1 * | 12/2011 | Hughes et al. | 700/97 |
| 2012/0018034 | A1 * | 1/2012 | Bertoli et al. | 141/9 |
| 2012/0031926 | A1 * | 2/2012 | Bertoli et al. | 222/144 |
| 2012/0175383 | A1 * | 7/2012 | Engels et al. | 222/135 |
| 2012/0175385 | A1 * | 7/2012 | Voskuil | 222/144 |
| 2012/0248137 | A1 * | 10/2012 | Baak et al. | 222/1 |
| 2013/0158704 | A1 * | 6/2013 | Hughes et al. | 700/239 |
| 2013/0284761 | A1 * | 10/2013 | Bui | 222/144 |
| 2014/0034674 | A1 * | 2/2014 | Engels et al. | 222/135 |
| 2015/0124553 | A1 * | 5/2015 | Hughes et al. | |
| 2015/0209744 | A1 * | 7/2015 | Korenkiewicz et al. | |

* cited by examiner

METHOD AND APPARATUS FOR PRODUCING PAINT

This application is a continuation of U.S. patent application by MicroBlend Technologies, Inc. entitled "METHOD AND APPARATUS FOR PRODUCING PAINT", Ser. No. 13/328,719, filed Dec. 16, 2011, now U.S. Pat. No. 8,936,390 the disclosure of which is hereby incorporated herein entirely by reference.

BACKGROUND OF THE INVENTION

1. Technical Field

This invention relates to a method and apparatus for producing an aqueous paint from a plurality of premixed compositions wherein the apparatus is cleaned during the paint production.

2. Background Art

The traditional manufacture of paint has utilized processes which continuously fill containers with a neutral or base color at the central facility. The containers are transported to the point of sale and stored until resale. The transport and storage in the individual containers adds significantly to the cost of the sold product for it is necessary to inventory a wide variety of paints having different finish characteristics to satisfy consumer demand. For example, the finishes offered for sale range from the traditional flat paint through varying resin compositions up to a high gloss finish. Inventory is maintained for all the different finishes at the point of sale by the merchant.

The manufacture of paint at the central facility can be either a batch process or an extended continuous mixing process. The process typically calls for mixing a pigment containing ground titanium dioxide along with a thickener, a viscosity controlling agent and resin added to the water base. The pigment is a composition with a high percentage solids suspended in water. Storage for any significant period of time of a premixed pigment composition typically results in settling and a non-uniform distribution of constituents throughout the premix. Consequently, manufacturing processes are designed to limit the residence time in premixing containers in order to promote the manufacture of more uniform products.

Accordingly, there is a need for a method and apparatus for the production of an aqueous paint composition from a plurality of premixed compositions that reduces or eliminates the need to store multiple cans of paint. Further, there is a need for the efficient operation and cleaning of the apparatus at the point of sale.

DISCLOSURE OF INVENTION

The present invention is directed to a method and apparatus for the production of an aqueous paint composition of varying finish characteristics at the point of sale wherein the apparatus is cleaned during the production of the aqueous paint composition. This method eliminates the need for the merchant or a maintenance crew to disassemble certain parts of the apparatus for cleaning and allows the apparatus to function efficiently and without adding contaminants to the final aqueous paint composition.

The present invention provides a method for producing an aqueous paint composition comprising: selecting a paint composition recipe through a user interface, wherein the paint composition recipe comprises at least three different stable premixed aqueous compositions selected from the group consisting of a stable pigment composition, a stable dispersant-thickening agent composition, a stable high resin composition, and/or a stable low resin composition, wherein at least one of said three different stable premixed aqueous compositions is the dispersant-thickening agent; computationally determining a cleaning amount of the dispersant-thickening agent composition and subtracting the cleaning amount of the dispersant-thickening agent composition from a total amount of the dispersant-thickening agent composition to equal a dispensing amount of the dispersant thickening composition; dispensing the dispensing amount of the dispersant-thickening agent composition and the at least three different stable premixed aqueous compositions to a receiving reservoir; and then dispensing the cleaning amount of the dispersant-thickening agent composition to the receiving reservoir and agitating the receiving reservoir to produce the aqueous paint composition.

The foregoing and other features and advantages of the invention will be apparent from the following more particular description of preferred embodiments of the invention, as illustrated in the accompanying drawings.

MODES FOR CARRYING OUT THE INVENTION

Figure 1A:
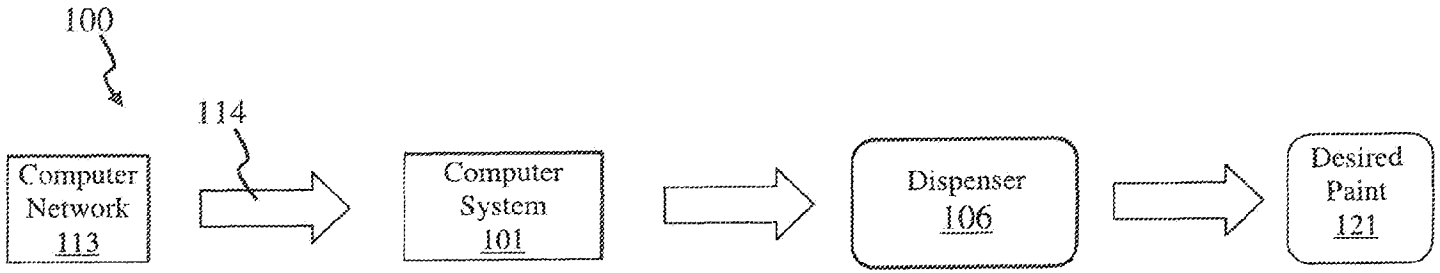
FIG. 1*a* is a block diagram of a paint manufacturing system, in accordance with the invention.

Four premixed aqueous compositions are sufficiently stable to be utilized at the point of sale to the user to generate a water-based paint composition having the desired finish characteristics. The four premixed aqueous compositions are mixed to develop paints ranging from a flat finish to a high gloss finish. However, all four of the aqueous compositions are not used to produce every paint composition.

The pigment-containing constituent or premixed pigment composition preferably contains titanium dioxide finely ground in an amount residing within the range of 40 to 50 percent by weight of the pigment. The ground titanium dioxide is a commercially available product used in a wide variety of paint compositions and its preparation techniques are well-known in the industry. The titanium dioxide is added to water which comprises about 25 percent of the resultant pigment composition. During the blending process, a mixture of calcined clay and silica in an amount of 15 percent by weight is added to maintain the titanium dioxide in suspension. A viscosity controlling agent is also added in an amount of about 10 percent of the resultant dispersion or pigment composition.

In order to maintain the titanium dioxide in a uniform dispersion, a dispersant-thickener is added during blending in an amount of less than 5 percent of the pigment composition. It has been found that the combination of a commercially-available dispersant supplemented by the addition of a phosphate-based dispersant such as potassium tri poly phosphate (KTPP) along with a modest amount of thickener enables the titanium dioxide pigment dispersion to remain uniform in distribution while stored.

The commercially available dispersant sold as Rhodaline 2861 (a federally registered trademark owned by Rhodia DSS) and manufactured by Rhodia DSS is the primary dispersant and is added in amount of about 3.6 weight percent. In addition, the phosphate based dispersant KTPP is added in an amount of about 0.2 weight percent to the pigment composition. It is believed that the phosphate ions in this additive replace the carbonate and other ions in the water to enhance the wetting properties of the water and thereby promote the distribution of the titanium dioxide throughout. The thickener added is a cellulosic thickening agent. Several are commercially available for use in the manufacture of aqueous paint compositions. One example is the thickener sold under the trademark 481 by AKZO NOBEL (Sweden).

The novel combination of these additives to the combination of titanium dioxide and water in the stated proportions has been found to enable the aqueous pigment composition to be used at point of sale to generate the wide scope of paint products. In tests of the pigment dispersion stored in a 55 gallon reservoir without agitation for a period of 2½ months, no discernible settling was noted. The addition of resin in an amount of about 5 percent of the dispersion has been found to aid in reducing the time for the resultant paint to cure. This factor is useful but tends to reduce the storage time of the pigment dispersion and is utilized only when a reduced curing time is important to the user.

At the point of sale, three additional premixed aqueous compositions are available to custom prepare the desired paint. The second composition in terms of likely usage is a dispersant-thickening agent which serves as a dilutant. The second composition is predominantly water in an amount of about 93 percent by weight. There are three additional additives to the second composition. They include a phosphate-based dispersant such as the potassium tri poly phosphate used in the pigment composition in an amount of less than 1 percent. The phosphate-based dispersant is added along with approximately a like amount of a thickener, such as cellulosic, HASE, HEUR and/or mixtures thereof. The combination of dispersant and thickener acts in the same manner as in the pigment composition although it is to be noted that the amount of thickener is several times that used in the pigment composition. The additional additive may be a coalescent, surfactant, defoamer, preservative and/or mixtures thereof in an amount of 4 to 5 weight percent. One commercial coalescent found suitable for use is sold under the federally registered trademark TEXANOL by Eastman Kodak Company.

The dispersant-thickening agent is preferably used in formulating all paint compositions with the exception of a high gloss finish paint composition. However, a small amount of dispersant-thickening agent may be used with high gloss finish paint compositions without any significant effects on paint quality. The dispersant thickening agent has also now been found to clean the nozzles and valves of the paint apparatus of the present invention.

The third and fourth compositions available for mixing are the resin-containing compositions. The low resin composition is preferably about 50 percent resin by weight and about 28 percent water. However, the percentage of resin by weight can be as low as 10 percent. To this mixture of resin and water is added diatomaceous earth as a flattening agent in the amount of about 7 percent and a combination of ground limestone, calcined clay, and/or other fillers. The combination of a dispersant and thickener are added in the aggregate amount of about 1.2 percent to promote the same long shelf life characteristic of the pigment composition.

The high resin component preferably contains resin in an amount of about 80 percent, water at about 15 percent and a commercially-available coalescent at about 2 percent. However, the percentage of resin by weight can be as high as about 90 percent. The amount of resin and water in the low and high resin compositions can be varied to achieve different finish characteristics. The resin utilized in the paint products formulated from the different combinations and found to provide the desired results is a 100 percent acrylic acrynol resin, such as the resin sold under the trademark 6629 by Arkema. However, it is to be noted that other commercially available resins can be used if desired.

The four above-discussed formulations have been determined to be stable and free from settling when stored in reservoirs for extended periods. To produce a desired paint product, each storage reservoir is coupled through fluid pumps and appropriate valves to dispensing outlets with the discharge therefrom preferably being directed into the receiving reservoir which is preferably the point of sale container or a portable paint container such as a paint bucket.

A flat finish product utilizes the dispersant thickening agent and low resin composition. To produce a higher quality flat paint and the paint products referred to as eggshell, satin and low sheen finishes a portion of high resin composition is added to the flat finish mixture. In the case of desired semi-gloss finish paint, the high resin component is used as a replacement for the low resin component. A full gloss paint utilizes the high resin component, but only a small amount of the dispersant thickening agent and no low resin composition. However, a small amount of dispersant-thickening agent may be used with full gloss paint without any significant effects on finish and/or paint quality.

The four compositions can also be varied to produce varying quality levels and to produce paint compositions that are suitable for either interior or exterior use and paint compositions having various color bases so that they are suitable for use as different types of colors. Therefore, it makes economic sense to have interior low resin and high resin compounds as well as exterior low resin and high resin components.

An interior paint composition will have less resin than a comparable exterior paint. Accordingly, interior paint compositions will have less of the high resin and/or low resin compositions than a comparable exterior paint composition. Quality is increased by decreasing the amount of dispersant thickening agent in a paint composition and increasing the amounts of the pigment composition and the low and high resin compositions. The amount of pigment composition is varied to change the type of color for which the paint composition is well-suited. Generally white base requires more pigment composition than pastels, pastels require more pigment composition than tinting, tinting requires more pigment composition than deep tone, and deep tone requires more pigment composition than neutral base. Typically neutral base paint compositions will not have any pigment composition.

The actual balances between the components for the different finishes can be varied in accordance with the needs of the purchaser for a particular type of finish. For example, a particular purchaser may require a paint composition that will have greater coverage. Also, color additives are added to vary the color of the paint after the four premixed aqueous compositions are added to form the basic paint composition.

Typical paint compositions suitable for programmed dispensing at the point of sale include the four aqueous compositions in the weight percentages shown below:

| Finish | Pigment Comp. | Disp-Thickening | Low Resin | High Resin |
|---|---|---|---|---|
| Flat | 33.7 | 0 | 34.7 | 31.6 |
| Satin | 36.4 | 17.9 | 9.6 | 39.3 |
| Semi-Gloss | 43.8 | 3.4 | 3.3 | 49.5 |
| High-Gloss | 44.5 | 0 | 0 | 55.5 |

All the foregoing examples are typical for retail quality paints suitable for interior and/or exterior use with pastel colors.

FIG. 1*a* is a block diagram of a paint manufacturing system 100, in accordance with the invention. In this embodiment, paint manufacturing system 100 includes a computer system 101 in communication with a computer network 113. Computer system 101 can be of many different types, such as a personal computer and laptop computer, and its operation will be discussed in more detail below. Computer network 113 can be of many different types, but it is generally a network of computer systems in communication with each other, as well as computer system 101. Examples of a computer network include the Internet, a local area network and wide area network.

It should be noted that computer system 101 is generally positioned at a point of sale, and computer network 113 is generally not positioned at the point of sale. In some examples, however, a portion of computer network 113 is positioned at the point of sale and is included with paint manufacturing system 100. For example, as discussed with FIG. 1*b*, computer network 113 can include an internet server that is positioned at the point of sale, wherein the internet server is included with paint manufacturing system 100. An internet server is a computer system that allows other computer systems to access data files, programs, records and peripheral devices through a computer network. An internet server can also process requests for text and multimedia documents, such as hypertext mark-up language (HTML) documents, that are typically associated with a web page.

Computer system 101 and computer network 113 can be in communication with each other in many different ways. In this embodiment, computer system 101 and computer network 113 are in communication with each other through a communication link 114, which allows the flow of signals between computer network 113 and computer system 101. Communication link 114 can be of many different types, such as a wireless or wired communication link. An example of a wireless communication link is a wireless modem and an example of a wired communication link is an Ethernet cable. The signals can be of many different types, such as those corresponding to digital data.

In this embodiment, paint manufacturing system 100 includes a dispenser 106 which is operatively coupled to computer system 101. More information regarding dispenser 106 is provided below with FIGS. 3*a*, 3*b*, 3*c* and 3*d*. In accordance with the invention, dispenser 106 dispenses a predetermined combination of paint components in response to a paint type indication being provided to computer system 101 through computer network 113 and communication link 114. Dispenser 106 dispenses at least two paint components in response to the paint type indication being provided to computer system 101. A desired paint 121 is formed in response to the paint components being dispensed by dispenser 106. In this way, computer system 101 is operatively coupled to a dispenser.

Dispenser 106 can dispense the paint components in response to the paint type indication being provided to computer system 101 in many different ways. In one embodiment, computer system 101 is operatively coupled to a paint component storage system (not shown), which is in fluid communication with dispenser 106. The paint component storage system flows the paint components to dispenser 106 in response to computer system 101 receiving the paint type indication through computer network 113 and communication link 114. In this way, computer system 101 is operatively coupled to a dispenser through a paint component storage system, and paint components are dispensed by paint manufacturing system in response to a paint type indication. More information regarding one embodiment of a paint component storage system is provided below with FIGS. 2*a* and 2*c*.

In some embodiments, paint manufacturing system 100 includes a colorant storage system (not shown) operatively coupled to computer system 101, wherein the colorant storage system is in fluid communication with dispenser 106. More information regarding one embodiment of a colorant storage system is provided below with FIGS. 4*a* and 4*c*. The colorant storage system flows a predetermined combination of colorant(s) to dispenser 106 in response to a paint color indication being provided to computer system 101. The paint color indication can be provided to computer system 101 in many different ways. In one embodiment, the paint color indication is provided to computer system 101 through computer network 113 and communication link 114. In this way, computer system 101 is operatively coupled to a dispenser through a colorant storage system, and one or more colorant are dispensed by paint manufacturing system in response to a paint color indication.

In some embodiments, paint manufacturing system 100 includes an additive storage system (not shown) operatively coupled to computer system 101, wherein the additive storage system is in fluid communication with dispenser 106. More information regarding one embodiment of an additive storage system is provided below with FIGS. 4*b* and 4*d*. The additive storage system flows a predetermined combination of additive(s) to dispenser 106 in response to a paint additive indication being provided to computer system 101. The paint additive indication can be provided to computer system 101 in many different ways. In one embodiment, the paint additive indication is provided to computer system 101 through computer network 113 and communication link 114. In this way, computer system 101 is operatively coupled to a dispenser through an additive storage system, and one or more additives are dispensed by paint manufacturing system in response to a paint additive indication.

Figure 1B:
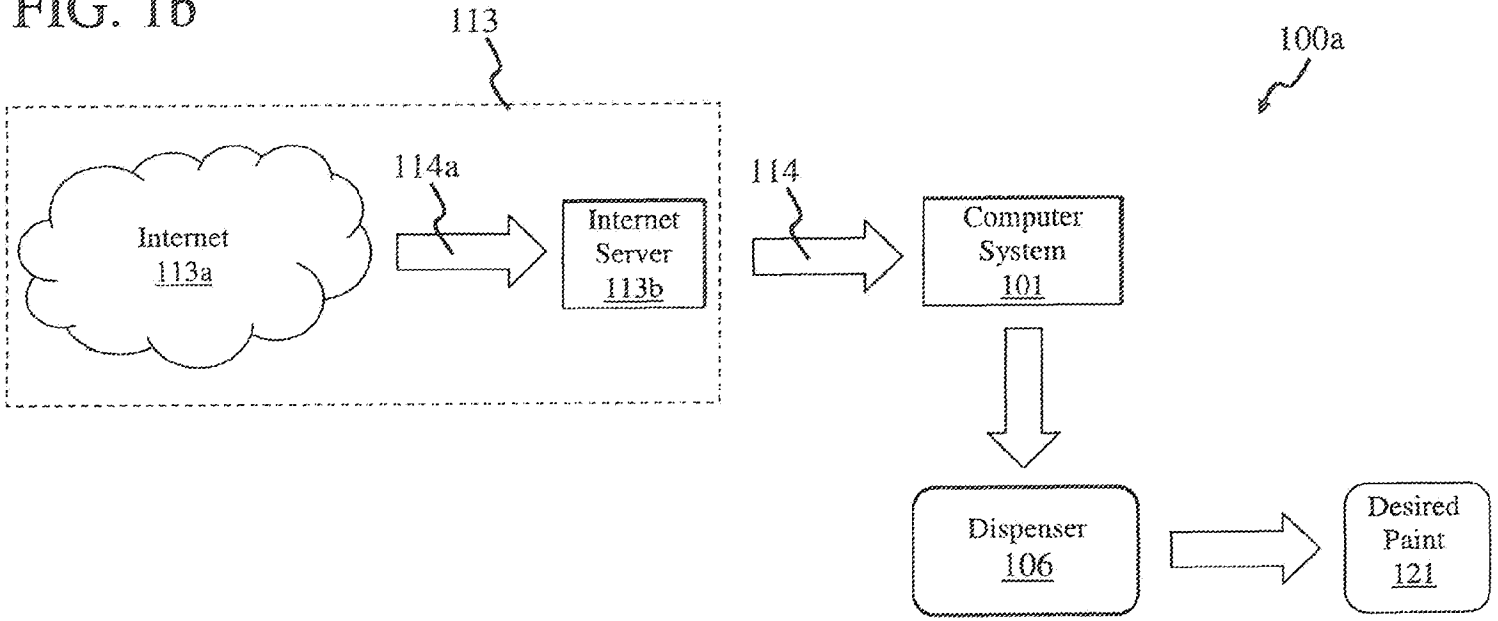
FIG. 1*b* is a block diagram of another embodiment of a paint manufacturing system, in accordance with the invention.

FIG. 1*b* is a block diagram of a paint manufacturing system 100*a*, in accordance with the invention. In this embodiment, paint manufacturing system 1 OOa includes computer system 101 and computer network 113 in communication with each other through communication link 114. As discussed above, computer system 101 is operatively coupled to dispenser 106, which dispenses the desired type and color of paint, as well as an additive, if desired. In this embodiment, computer network 113 includes Internet 113*a* and an internet server 113*b* in communication with each other through a communication link 114*a*, wherein communication link 114*a* can be the same or similar to communication link 114.

As mentioned above, computer system 101 is positioned at the point of sale. Further, in this embodiment, internet server 113*b* is also positioned at the point of sale. In this way, a portion of computer network 113 (i.e. internet server 113*b*) is positioned at the point of sale and another portion (i.e. Internet 113*a*) is not. It should be noted that, in some embodiments, internet server 113*b* is positioned so it is not at the point of sale. Further, in some embodiments, another portion of Internet 113*a*, other than internet server 113*b*, is positioned at the point of sale.

In operation, the consumer uses Internet 113*a* to access, through communication link 114*a*, a web page hosted by internet server 113*b* and selects the desired type and color of paint he or she desires, as well as any additives. When the paint is selected, internet server 113*b* provides this information to computer system 101 through communication link 114 and, in response, dispenser 106 dispenses the paint components and colorants, as well as the additives, to form desired paint 121.

It should be noted that the consumer can pay for desired paint 121 in many different ways. For example, the consumer can pay for desired paint 121 using Internet 113*a* to access, through communication link 114*a*, the web page hosted by internet server 113*b*. The consumer can also pay for desired paint 121 when he or she goes to the point of sale to pick it up. The consumer can pay for desired paint 121 after it is shipped to a desired location, such as his or her home or place of business.

In some situations, the consumer pays for desired paint 121 before its paint components are dispensed by dispenser 106 and, in other situations, the consumer pays for desired paint 121 after its paint components are dispensed by dispenser 106. In some situations, the consumer pays for desired paint 121 before its colorant(s) are dispensed by dispenser 106 and, in other situations, the consumer pays for desired paint 121 after its colorant(s) are dispensed by dispenser 106. In some situations, the consumer pays for desired paint 121 before its additive(s) are dispensed by dispenser 106 and, in other situations, the consumer pays for desired paint 121 after its additive(s) are dispensed by dispenser 106.

Figure 2A:
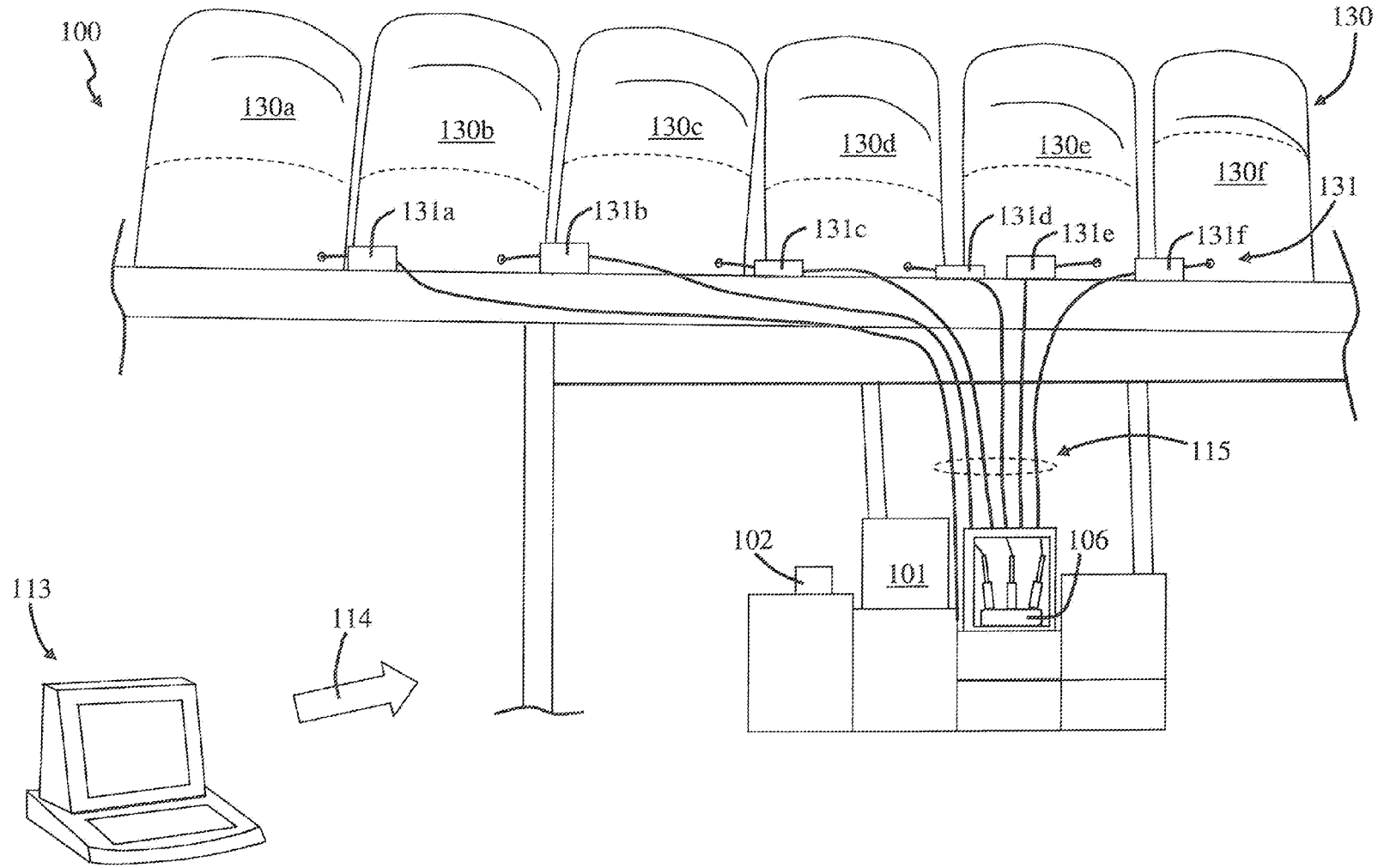
FIG. 2*a* is a perspective view of the paint manufacturing system of FIG. 1*a*.
Figure 2B:
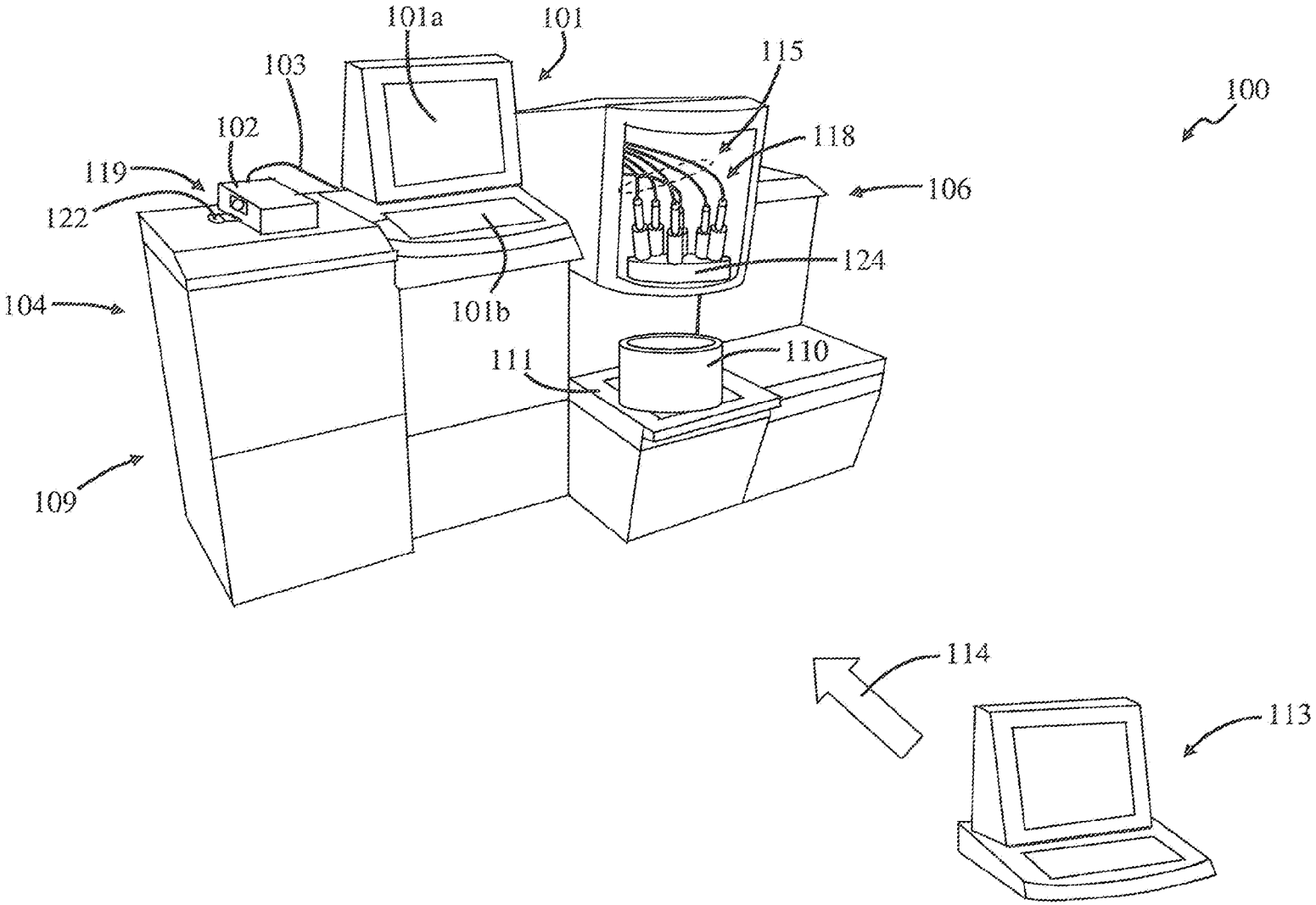
FIG. 2*b* is a close-up perspective view of a portion of the paint manufacturing system of FIG. 2*a*.
Figure 2C:
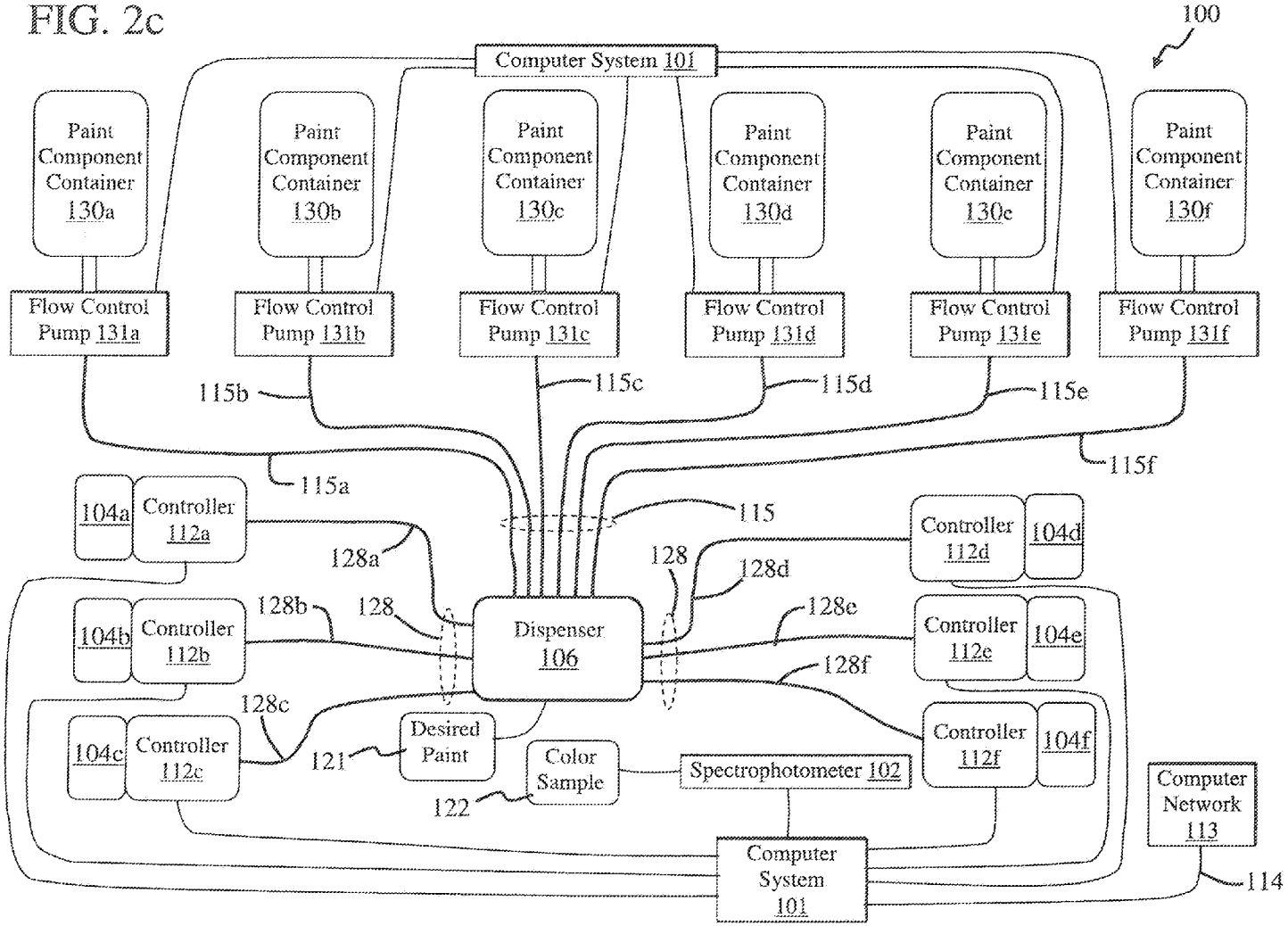
FIG. 2*c* is a schematic diagram of the paint manufacturing system of FIG. 2*a*, showing a colorant storage system.
Figure 2D:
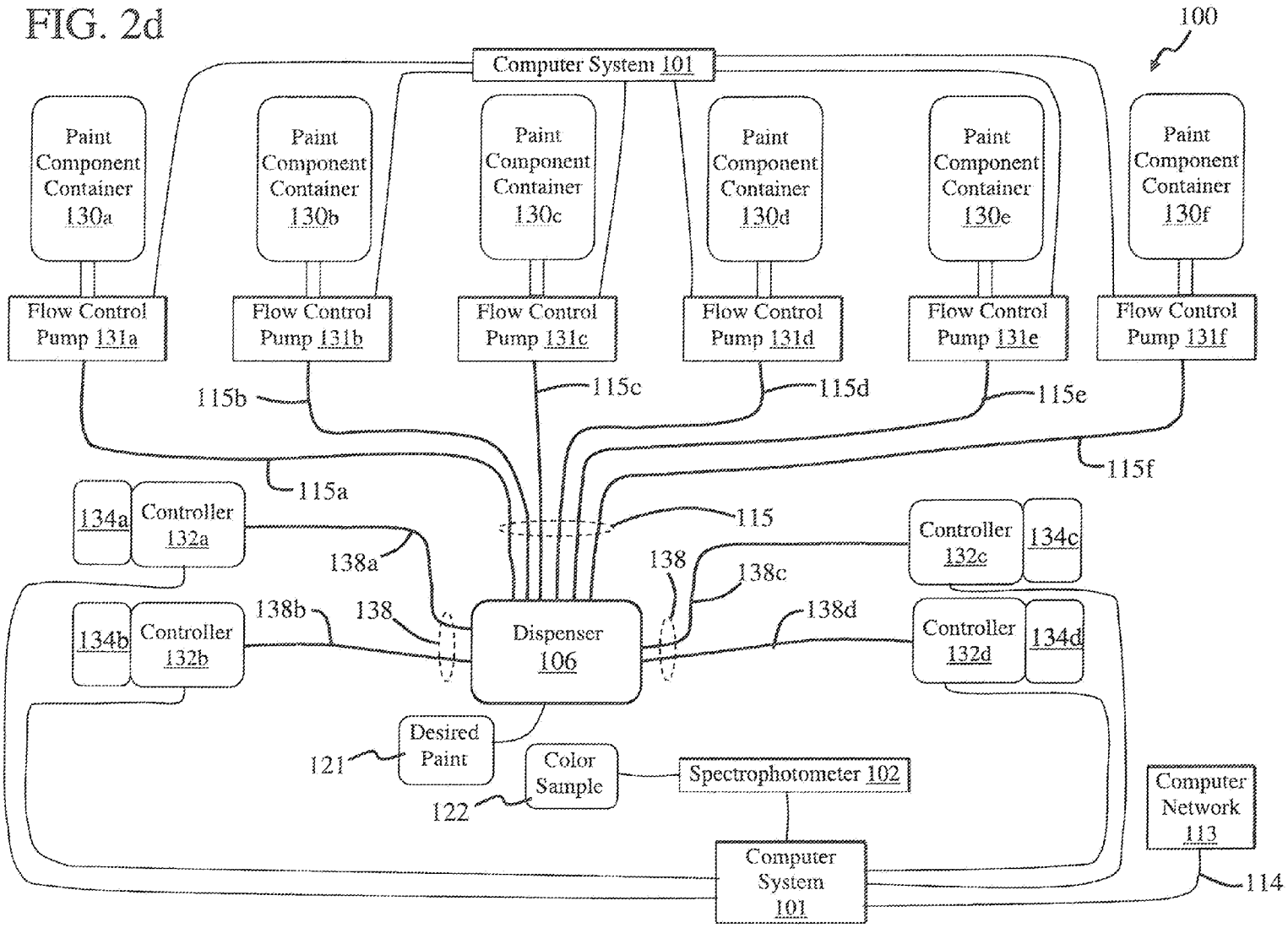
FIG. 2*d* is a schematic diagram of the paint manufacturing system of FIG. 2*a*, showing an additive storage system.

FIG. 2*a* is a perspective view of paint manufacturing system 100, in accordance with the invention, and FIG. 2*b* is a close-up perspective view of paint manufacturing system 100. FIGS. 2*c* and 2*d* are schematic diagrams of paint manufacturing system 100 showing a colorant storage system 104 and additive storage system 134, respectively. In this embodiment, paint manufacturing system 100 includes computer system 101 in communication with computer network 113 through communication link 114, as described above. Computer system 101 includes a monitor 101*a* and an input device 101*b*, wherein monitor 101*a* is embodied as a touch-screen monitor and input device 101*b* is embodied as a keyboard. Computer system 101 operates software that allows it to communicate with computer network 114 and allows it to control the operation of several paint manufacturing system components, such as a paint component storage system 130 (FIG. 2*a*), colorant storage system 104 (FIG. 2*c*) and additive storage system 134 (FIG. 2*d*). Paint component storage system 130, colorant storage system 104 and additive storage system 134 can be positioned at many different locations, but, in this embodiment, they are positioned at the point of sale. In this way, paint manufacturing system 100 is capable of providing the desired type and color of paint, as well as any additives, at the point of sale.

As mentioned above, the paint components, colorant(s) and/or additive(s) are predetermined in response to one or more indications provided to computer system 101. In some situations, the indications are provided to computer system 101 through monitor 101*a* and/or input device 101*b*. However, in accordance with the invention, the indications are provided to computer system 101 through computer network 113 and communication link 114. More information regarding the flow of information between computer system 101 and computer network 113 is provided above with FIGS. 1*a* and 1*b*.

As mentioned above, paint manufacturing system 100 includes dispenser 106, wherein the material dispensed by dispenser 106 is controlled by computer system 101, as will be discussed in more detail below. Dispenser 106 dispenses materials which form desired paint 121 and provide it with the desired color and additives.

In this embodiment, and as shown in FIG. 2*b*, dispenser 106 includes paint component nozzles 118 supported by a nozzle support structure 124. Nozzles 118 are connected to paint component storage system 130 through a paint component plumbing system 115, and dispense pre-selected paint components in response to an indication from computer system 101. Nozzles 118 dispense pre-selected paint components in response to the paint type indication being provided to computer system 101.

In this embodiment, paint component storage system 130 includes paint component storage containers 130*a*, 130*b*, 130*c*, 130*d*, 130*e* and 130*f* (FIG. 2*a*). It should be noted that six paint component containers are shown in this embodiment, but there are generally two or more. The number of paint component storage containers corresponds to the number of paint components system 100 is capable of providing. In one particular example, containers 130*a*, 130*b*, 130*c* and 130*d* each contain the pigment composition, dispersant thickening agent, high resin content binder and low resin content binder, respectively. In this way, each paint component storage container contains a material which consists essentially of a paint component. Further, in general, each paint component storage container of system 130 contains a material which consists essentially of a single type of paint component.

In this embodiment, paint component storage system 130 is in fluid communication with plumbing system 115 through a paint component mass flow controller system 131. Mass flow controller system 131 includes paint component mass flow controllers 131*a*, 131*b*, 131*c*, 131*d*, 131*e* and 131*f*. As shown in FIG. 2*c*, paint component containers 130*a*, 130*b*, 130*c*, 130*d*, 130*e* and 130*f* are in fluid communication with paint component hoses 115*a*, 115*b*, 115*c*, 115*d*, 115*e* and 115*f*, respectively, through mass flow controllers 131*a*, 131*b*, 131*c*, 131*d*, 131*e* and 131*f*, respectively. As shown in FIG. 2*c*, plumbing system 115 includes hoses 115*a*, 115*b*, 115*c*, 115*d*, 115*e* and 115*f* which allow paint components to flow between paint component storage system 130 and paint component nozzles 118 in response to the paint type indication being provided to computer system 101.

Computer system 101 controls the operation of mass flow controllers 131*a*-131*f* to control the amount of paint components which are allowed to flow through hoses 115*a*-115*f*, respectively. The operation of mass flow controllers 131*a*-131*f* can be controlled by computer system 101 in many different ways, such as by providing the paint type indication to system 101 through monitor 101*a* and/or input device 101*b*. In accordance with the invention, however, the operation of mass flow controllers 131*a*-131*f* is controlled by computer system 101 in response to the paint type indication being received by computer system 101 through computer network 113 and communication link 114. In this way, computer system 101 is operatively coupled to dispenser 106 through a paint component storage system, and paint components are dispensed by dispenser 106 in response to a paint type indication.

The paint components are dispensed through paint component nozzles 118 and into a paint container 110. Paint container 110 can be of many different types, such as a paint bucket, which allows the paint to be contained and carried away from the point of sale. In this embodiment, paint container 110 is supported on a paint weight scale 111, which determines the weight of paint container 110 combined with the weight of the material, such as the paint components, colorants and/or additives, dispensed through dispenser 106. Scale 111 can be of many different types, such as the PANTHER and PANTHER PLUS weighing terminals made by Mettler Toledo of Toledo, Ohio.

Figure 3A:
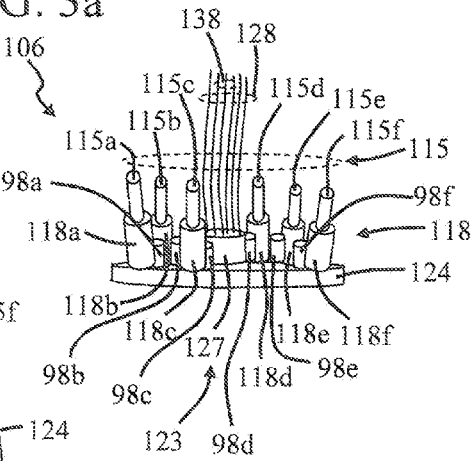
FIG. 3*a* is a perspective view of one embodiment of a dispenser, in accordance with the invention, included with the paint manufacturing system of FIG. 2*a*.
Figure 3B:
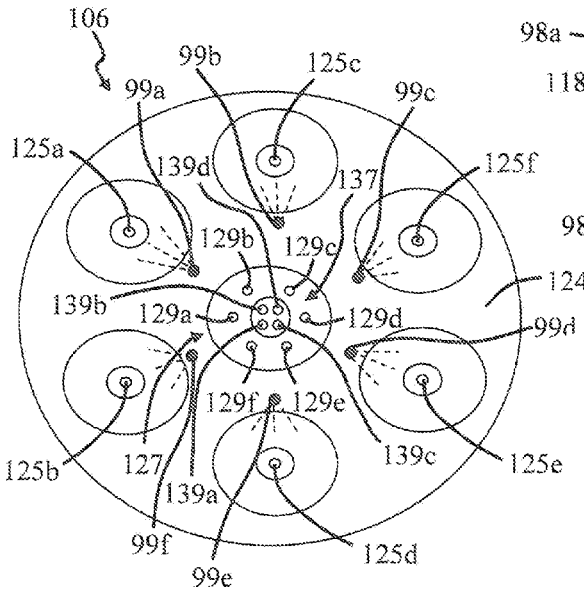
FIG. 3*b* is a bottom view of the dispenser of FIG. 3*a*.

FIG. 3*a* is a perspective view of one embodiment of dispenser 106, in accordance with the invention, and FIG. 3*b* is a bottom view of dispenser 106 looking in a direction 123 of FIG. 3*a*. In this embodiment, paint component nozzles 118 includes six paint component nozzles, denoted as nozzles 118*a*, 118*b*, 118*c*, 118*d*, 118*e* and 118*f* and pumps 98*a*, 98*b*, 98*c*, 98*d*, 98*e* and 98*f*. Pumps 98*a*, 98*b*, 98*c*, 98*d*, 98*e* and 98*f* are supported by nozzle support structure 124 and are in fluid communication with paint component storage system 130 through hoses 115*a*, 115*b*, 115*c*, 115*d*, 115*e* or 115*f*, respectively, of plumbing system 115 depending on which paint component container 130*a*, 130*b*, 130*c*, 130*d*, 130*e* or 130*f*, contains the dispersant-thickening agent component. Nozzles 118*a*, 118*b*, 118*c*, 118*d*, 118*e* and 118*f* are also supported by nozzle support structure 124 and are in fluid communication with paint component storage system 130 through hoses 115*a*, 115*b*, 115*c*, 115*d*, 115*e* and 115*f*, respectively, of plumbing system 115. In this way, nozzles 118*a*, 118*b*, 118*c*, 118*d*, 118*e* and 118*f* are in fluid communication with paint component containers 130*a*, 130*b*, 130*c*, 130*d*, 130*e* and 130*f*, respectively. It should be noted that hoses 115*a*-115*f* terminate at paint component openings 125*a*, 125*b*, 125*c*, 125*d*, 125*e* and 125*f*, respectively, as shown in FIG. 3*b*. Openings 125*a*-125*f* extend through a bottom surface of nozzle support structure 124 so that the respective paint components are outputted through them and into paint container 110.

Cleaning squirt nozzles 99*a*, 99*b*, 99*c*, 99*d*, 99*e* and 99*f* are also supported by nozzle support structure 124 and are in fluid communication with paint component storage system 130 through hoses 115*a*, 115*b*, 115*c*, 115*d*, 115*e* or 115*f*, respectively, of plumbing system 115 depending on which paint component container 130*a*, 130*b*, 130*c*, 130*d*, 130*e* or 130*f*, contains the dispersant-thickening agent component. In this way, nozzles 99*a*, 99*b*, 99*c*, 99*d*, 99*e* and 99*f* are in fluid communication with paint component containers 130*a*, 130*b*, 130*c*, 130*d*, 130*e* or 130*f*, depending on which paint component container contains the dispersant-thickening agent component.

Figure 3D:
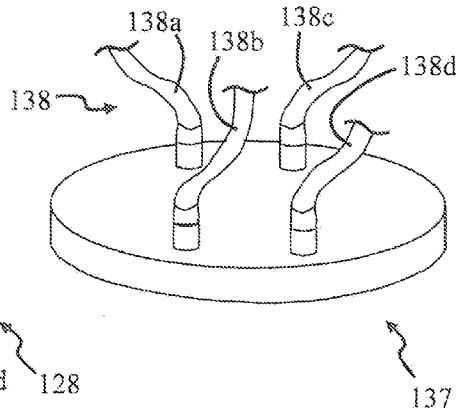
FIG. 3*d* is a perspective view of an additive nozzle included with the dispenser of FIG. 3*a*.
Figure 3C:
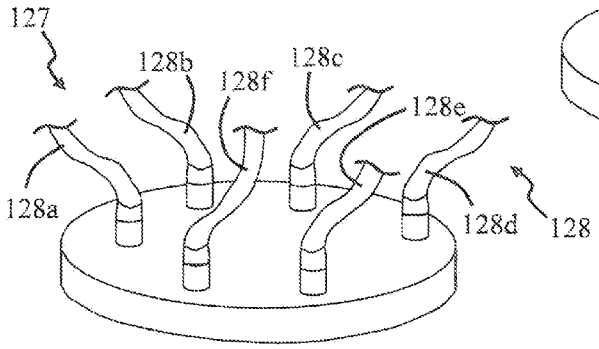
FIG. 3*c* is a perspective view of a colorant nozzle included with the dispenser of FIG. 3*a*.

In this embodiment, dispenser 106 includes a colorant nozzle 127, as shown in a perspective view in FIG. 3*c*, carried by nozzle support structure 124. Colorant nozzle 127 is connected to colorant storage system 104 through a colorant plumbing system 128 (FIG. 3*a*). Plumbing system 128 allows colorant components to flow between colorant storage system 104 and colorant nozzle 127. Plumbing system 128 includes six colorant hoses, denoted as hoses 128*a*, 128*b*, 128*c*, 128*d*, 128*e* and 128*f*, which extend through nozzle 127 and terminate at colorant openings 129*a*, 129*b*, 129*c*, 129*d*, 129*e* and 129*f*, respectively, as shown in FIG. 3*b*. It should be noted that the number of hoses in plumbing system 128 typically corresponds to the number of colorants included in colorant storage system 104. The colorant components are dispensed through openings 129*a*-129*f* and into paint container 110 wherein they are combined with the paint components. As will be discussed in more detail below with FIGS. 4*a* and 4*c*, the flow of colorants through plumbing system 128 is controlled by computer system 101. In particular, the colorants are flowed through plumbing system 128 in response to the paint color indication being provided to computer system 101. In this way, computer system 101 is operatively coupled to dispenser 106 through a colorant storage system.

In this embodiment, dispenser 106 includes an additive nozzle 137, as shown in a perspective view in FIG. 3*d*, carried by nozzle support structure 124. It should be noted that additive nozzle 137 is shown as extending through colorant nozzle 127 for illustrative purposes. However, additive nozzle 137 can be positioned at other locations of nozzle support structure 124. Additive nozzle 137 is connected to additive storage system 134 through an additive plumbing system 138 (FIG. 3*a*). Plumbing system 138 allows additives to flow between additive storage system 134 and colorant nozzle 137. Plumbing system 138 includes four additive hoses, denoted as hoses 138*a*, 138*b*, 138*c* and 138*d* (FIG. 3*d*), which extend through nozzle 137 and terminate at nozzle openings 139*a*, 139*b*, 139*c* and 139*d*, respectively, as shown in FIG. 3*b*. It should be noted that the number of hoses in plumbing system 138 typically corresponds to the number of additives included in additive storage system 134. The additives are dispensed through openings 139*a*-139*f* and into paint container 110 wherein they are combined with the paint. As will be discussed in more detail with FIGS. 4*b* and 4*d*, the flow of additives through plumbing system 138 is controlled by computer system 101. In particular, the additives are flowed through plumbing system 128 in response to the paint additive indication being provided to computer system 101. In this way, computer system 101 is operatively coupled to dispenser 106 through an additive storage system.

Figure 4A:
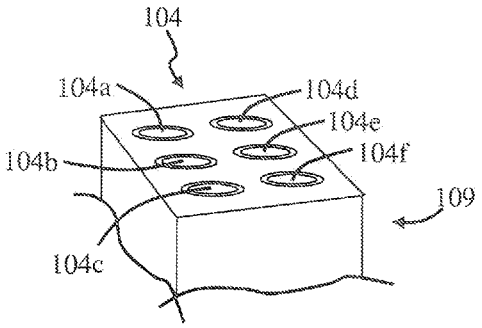
FIGS. 4*a* and 4*b* are perspective views of colorant and additive storage systems, respectively, in accordance with the invention, included with the paint manufacturing system of FIG. 2*a*.
Figure 4B:
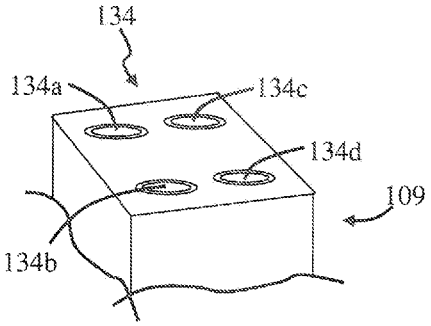
Figure 4C:
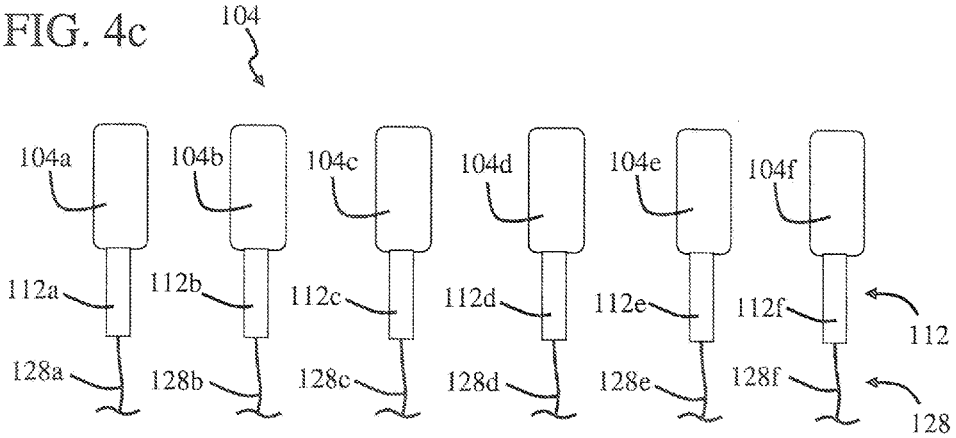
FIGS. 4*c* and 4*d* are schematic diagrams of the colorant and additive storage systems of FIGS. 4*a* and 4*b*, respectively.
Figure 4D:
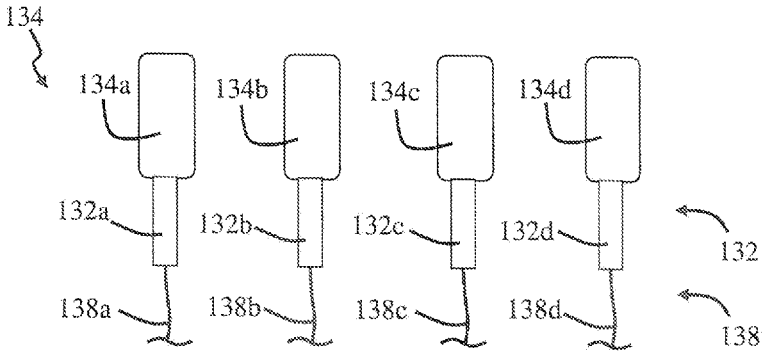

FIGS. 4*a* and 4*b* are perspective views of one embodiment of colorant storage system 104 and additive storage system 134, respectively, in accordance with the invention. Further, FIGS. 4*c* and 4*d* are schematic diagrams of colorant storage system 104 and additive storage system 134, respectively. It should be noted that colorant storage system 104 and additive storage system 134 are typically housed by paint manufacturing system 100 in a colorant storage cabinet 109, as shown in FIG. 2*b*, although they can be housed elsewhere.

In this embodiment, colorant storage system 104 is connected to plumbing system 128 through a colorant mass flow control system 112. Colorant storage system 104 includes colorant storage containers 104*a*, 104*b*, 104*c*, 104*d*, 104*e* and 104*f* and mass flow control system 112 includes colorant mass flow controllers 112*a*, 112*b*, 112*c*, 112*d*, 112*e* and 112*f*. Colorant storage containers 104*a*, 104*b*, 104*c*, 104*d*, 104*e* and 104*f* are connected to colorant hoses 128*a*, 128*b*, 128*c*, 128*d*, 128*e* and 128*f*, respectively, through mass flow controllers 112*a*, 112*b*, 112*c*, 112*d*, 112*e* and 112*f*, respectively.

Computer system 101 controls the operation of colorant mass flow controllers 112*a*-112*f* to control the amount of colorants which are allowed to flow through corresponding colorant hoses 128*a*-128*f*. The operation of mass flow controllers 112*a*-112*f* can be controlled by computer system 101 in many different ways, such as by providing the paint color indication to system 101 through monitor 101*a* and/or input device 101*b*. In accordance with the invention, however, the operation of colorant mass flow controllers 112*a*-112*f* is controlled by computer system 101 in response to the paint color indication being received by computer system 101 through computer network 113 and communication link 114. In this way, computer system 101 is operatively coupled to dispenser 106 through a colorant storage system, and colorants are dispensed by dispenser 106 in response to a paint color indication.

Colorant containers 104*a*-104*f* each contain a type of colorant which can be flowed into paint container 110 through colorant hoses 128*a*-128*f* and corresponding openings 129*a*-129*f* (FIG. 3*b*), as discussed above, wherein they are combined with the paint components contained in container 110. In this way, the color of the paint components contained in container 110 is driven to the desired color.

It should be noted that, in this embodiment, colorant storage system 104 is shown as including six colorant containers for illustrative purposes, so it can provide six colors, as well as their corresponding color combinations. A color combination is two or more colors combined together to provide a shade of color. The two or more colors can be combined together in many different ways, such as by mixing. In other embodiments, however, colorant storage system 104 includes fewer or more colorants. For example, in one particular embodiment, colorant storage system 104 includes twelve colorant containers, so it can provide twelve colors, as well as their corresponding color combinations. In general, the number of colorant containers included in colorant storage system 104 determines the number of different colors and shades of colors that can be provided. The number of different colors and shades of colors that can be provided increases with the number of colorant containers. Further, the number of different colors and shades of colors that can be provided decreases with the number of colorant containers. The amount and colors of colorants flowed into paint container 110 can be determined in many different ways, a few of which will be discussed in more detail below.

In this embodiment, additive storage system 134 is connected to additive plumbing system 138 through an additive mass flow control system 132. Additive storage system 104 includes additive storage containers 134*a*, 134*b*, 134*c* and 134*d* and mass flow control system 132 includes additive mass flow controllers 132*a*, 132*b*, 132*c* and 132*d*. Additive storage containers 134*a*, 134*b*, 134*c* and 134*d* are connected to hoses 138*a*, 138*b*, 138*c* and 138*d*, respectively, through mass flow controllers 132*a*, 132*b*, 132*c* and 132*d*, respectively.

Further, computer system 101 controls the operation of mass flow controllers 132*a*-132*d* to control the amount of additives which are allowed to flow through corresponding hoses 138*a*-138*d*. The operation of mass flow controllers 132*a*-132*d* can be controlled by computer system 101 in many different ways, such as by providing the paint additive indication to system 101 through monitor 101*a* and/or input device 101*b*. In accordance with the invention, however, the operation of mass flow controllers 132*a*-132*d* is controlled by computer system 101 in response to the paint additive indication being received by computer system 101 through computer network 113 and communication link 114. In this way, computer system 101 is operatively coupled to dispenser 106 through an additive storage system and additives are dispensed by dispenser 106 in response to a paint additive indication.

Additive containers 134*a*-134*d* each contain a type of additive which can be flowed into paint container 110 through hoses 138*a*-138*d* and corresponding openings 139*a*-139*d* (FIG. 3*b*), as discussed above, wherein they are combined with the paint components contained in container 110. The additive(s) can be combined with the paint components in many different ways, such as by mixing.

It should be noted that, in this embodiment, additive storage system 134 is shown as including four additive containers for illustrative purposes, so it can provide four types of additives, as well as combinations thereof. In other embodiments, however, additive storage system 134 can include fewer or more additive containers. For example, in one particular embodiment, additive storage system 134 includes six additive containers, so it can provide six additives, as well as combinations thereof. In general, the number of additive containers included in additive storage system 134 determines the number of different additives and combinations of additives that can be provided. The number of different additives that can be provided increases with the number of additive containers. Further, the number of different additives that can be provided decreases with the number of additive containers. The type and amount of additives flowed into paint container 110 can be determined in many different ways, a few of which will be discussed in more detail presently.

In operation, computer system 101 has access to a paint data file, which generally includes paint color and paint type information. In this embodiment, the paint color and paint type information are included in the same data file. However, the paint color and paint type information can be included with a paint color data file and a paint type data file, respectively, so that the paint data file includes separate data files. Further, computer system 101 has access to a paint additive date file which corresponds to a desired type of additive to be added to the paint components. The additive data file can be included with the paint data file which includes the paint color and/or paint type information, or the additive data file can be a separate data file.

The paint color and paint type information can be read and changed, if desired, by computer system 101. In some situations, the paint color and paint type information can be changed in response to a signal received by computer system 101 through monitor 101*a* and/or input device 101*b*. However, in accordance with the invention, the paint color and paint type information can be changed in response to a signal received by computer system 101 through computer network 113 and communication link 114. In one particular embodiment, the paint color and/or paint type information are changed in response to a signal received by computer system 101 through internet server 113*b* and communication link 114.

The paint data file can be an existing data file, or it can be created or changed in response to the paint type, paint color and/or paint additive indications provided to computer system 101. The changes to the paint data file can be made by sending one or more signals to computer system 101 through computer network 113 and communication link 114. Further, the paint color, paint type and/or paint additive data files can be existing data files, or they can be created or changed in response to the paint color, paint type and paint additive indications, respectively. The paint data file, color data file, paint type data file and/or paint additive data file can be stored internally with computer system 101 or externally to it, such as with internet server 113*b*.

In some embodiments, the paint color, paint type and/or paint additive indications are stored by the consumer on internet server 113*b*. In these embodiments, the consumer can create a user account on internet server 113*b* and store information corresponding to the paint color, paint type and paint additive indications for later use. This is useful when the consumer desires to purchase paint corresponding to the same type and color of paint they previously purchased, wherein the paint includes the same type and amount of additive.

The color data file includes paint color information which corresponds to the desired color of the paint manufactured with paint manufacturing system 100. The paint color information often represents the desired color in terms of a particular color scale. There are many different color scales that can be used to represent the desired color, with one being the Hunter color scale. The Hunter color scale represents colors with three color values, denoted as L, a and b. Hence, the paint color information can include L, a and b values corresponding to the desired color.

The paint type data file includes paint type information which corresponds to the desired type of the paint manufactured with paint manufacturing system 100. It should be noted that the desired type of paint includes a base paint, and the base paint typically depends on the desired color of paint. This is because the colorants are combined with the base paint to provide the paint with a desired shade of color. For example, if a dark color is desired, the paint type indication generally corresponds to a neutral base paint. If a light color is desired, the paint type indication generally corresponds to a pastel base paint. Colorants are combined with the base paint to provide a shade of color between pastel and neutral. Hence, the paint color indication depends on the paint type indication and the color data file depends on the paint type data file.

As mentioned above, the paint type, paint color and paint additive indications can be provided to computer system 101 in many different ways. In accordance with the invention, the paint type, paint color and paint additive indications are provided to computer system 101 by computer network 113 through communication link 114. In other situations, the paint type, paint color and paint additive indications are provided to computer system 101 by providing corresponding input through monitor 101*a* and/or input device 101*b*. The paint type, paint color and paint additive indications are generally provided to computer system 101 in response to an indication that a consumer desires a particular type and color of paint, which includes the desired additive. The paint type, paint color and paint additive data files are selected in response to the paint type, paint color and paint additive indications, respectively, provided to computer system 101.

In one situation, the paint type and paint color indications are provided to computer system 101 in response to one or more inputs provided to computer system 101 through computer network 113 and communication link 114. A paint type data file is selected in response to the paint type indication. The selected paint type data file corresponds to a base paint having a color associated with the color indicated by the paint color indication. A color data file is selected in response to the desired paint color indication. The selected color data file corresponds to the type and amount of colorants that will drive the color of the base paint, when combined therewith, to the desired color. In this way, the desired type of paint having the desired color is manufactured, by using a paint manufacturing system, in response to a remote indication that a consumer wants a desired paint.

If desired, the additive can be added to the base paint, as described in more detail above. For example, the additive can be added to the base paint by providing the paint additive indication to computer system 101 through computer network 113 and communication link 114. Further, the additive can be added to the base paint by providing the paint additive indication to computer system 101 through monitor 101*a* and/or input device 101*b*.

In another situation, the paint type and paint color indications are provided to computer system 101 in response to one or more inputs provided to computer system 101 through monitor 101*a* and/or input device 101*b*. A paint type data file is selected in response to the paint type indication. The selected paint type data file corresponds to a base paint having a color associated with the color indicated by the paint color indication. In response to the desired paint color indication, a color data file is selected. The selected color data file corresponds to the type and amount of colorants that will drive the color of the base paint, when combined therewith, to the desired color. In this way, the desired type of paint having the desired color is manufactured, by using paint manufacturing system 100, in response to an indication that a consumer wants a desired paint. In other situations, however, the paint color indication is provided to computer system 101 with a colorant signal, as will be discussed in more detail below. If desired, the additive can be added to the base paint by providing the paint additive indication to computer system 101 through monitor 101*a* and/or input device 101*b*.

In one situation, the paint type, paint color, and paint additive indications are provided to computer system 101 in response to one or more inputs provided to computer system 101 through monitor 101*a* and/or input device 101*b*. A paint type data file is selected in response to the paint type indication. The selected paint type data file corresponds to a base paint having a color associated with the color indicated by the paint color indication. In response to the desired paint color indication, a color data file is selected. The selected color data file corresponds to the type and amount of colorants that will drive the color of the base paint, when combined therewith, to the desired color. Further, a paint additive data file is selected in response to the paint additive indication. The selected paint additive indication corresponds to the desired type and amount of additive to be added to the paint components. In this way, the desired type of paint having the desired color and additive is manufactured, by using paint manufacturing system 100, in response to an indication that a consumer wants a desired paint. In other situations, however, the paint color indication is provided to computer system 101 with a colorant signal, as will be discussed in more detail presently.

As shown in FIG. 2*b*, paint manufacturing system 100 includes a spectrophotometer 102 in communication with computer system 101. Spectrophotometer 102 can be in communication with computer system 101 in many different ways, but a cable 103 is used here. In this way, computer system 101 and spectrophotometer 102 are operatively coupled together so signals can flow between them. Spectrophotometer 102 can be of many different types, such as those available from Greta Macbeth, MatchRite and Datacolor. Examples of spectrophotometers are also disclosed in U.S. Pat. Nos. 6,002,488 and 6,198,536.

Spectrophotometer 102 includes a sample holder 119 for holding a color sample 122. Color sample 122 can be of many different types, but it is often a color card corresponding to the desired color. In this way, the color of color sample 122 corresponds to the desired color of paint to be manufactured using paint manufacturing system 100.

In operation, spectrophotometer 102 flows a colorant signal $S_{Colorant}$ to computer system 101 through cable 103, wherein colorant signal $S_{Colorant}$ corresponds to the reflectance of color sample 122. The reflectance of color sample 122 corresponds to its paint color information. In response to colorant signal $S_{Colorant}$, computer system 101 stores the paint color information. The paint color information can be stored in many different locations, such as with the paint data file or an existing or created color data file. In this way, computer system 101 has access to paint color information corresponding to the color of color sample 122.

Once computer system 101 has access to the desired paint type and color information, computer system 101 determines the paint components and colorants needed to drive the color of the paint components to match the desired color. In this way, computer system 101 determines the paint components and colorants needed to drive the color of the base paint to match the desired color. It should be noted that, in accordance with the invention, the paint components and colorants are determined before they are dispensed. However, in some embodiments, the paint components and colorants can be determined after one or more of them are dispensed. For example, the paint components can be dispensed before the colorants are determined. It should be noted that it is generally desirable to decrease the amount of time between when the paint components and colorants are dispensed to preserve the quality of the paint.

After the paint type and colorants have been determined, computer system 101 provides an indication to mass flow control system 131 so that paint component storage system 130 dispenses the selected paint components. More information regarding the mass flow control system and paint component storage system is provided with FIGS. 2*a* and 2*c*. The selected paint components are dispensed by dispenser 106 to form the base paint, which is contained by container 110. Computer system 101 also provides an indication to mass flow control system 112 so that colorant storage system 104 dispenses the selected colorants. The selected colorants are dispensed by dispenser 106 into container 110 to drive the color of the base paint to match the desired color. If the color indication is provided by selecting the color data file, the color is driven to match the color corresponding to the paint color information included therein. If the color indication is provided by signal $S_{Colorant}$, the color is driven to match the color of color sample 122. In this way, the paint color indication can be provided to computer system 101 by using a spectrophotometer and a color sample.

It should be noted that the colorants can be selected in many different ways. For example, they can be selected to provide a desired accuracy in matching the color of the paint to the color of color sample 122. The colorants can also be selected based on cost. This is useful because some colorants are more expensive than others. Hence, the colorants can be selected to reduce costs, as well as the accuracy in color matching. The colorants can also be chosen in response to a desired use. For example, some colorants are better suited for outdoor use and other colorants are better suited for indoor use.

The program operated by computer system 101 determines the type of paint components, as well as their amounts, necessary to make the desired type of paint. In response to the determination of the type of paint components, computer system 101 operates flow control system 131 so that paint component storage system 130 flows the amount and type of paint components to dispenser 106 through plumbing system 115. The paint components are dispensed by nozzles 118 into paint container 110, as described above, to form desired paint 121. In this way, nozzles 118 dispense pre-selected paint components in response to an indication from computer system 101. The amount of paint components dispensed can be determined in many different ways, such as by volume and weight. In this embodiment, however, the paint components are dispensed by weight, as determined by paint weight scale 111.

The program operated by computer system 101 also determines a cleaning amount of the dispersant-thickening agent component to make the desired type of paint and subtracts the cleaning amount from the total amount of dispersant thickening agent for making the desired type of paint to equal the dispensing amount of dispersant thickening agent. Generally, the cleaning amount of the dispersant-thickening agent is in the range of about 0.25% by weight to about 25% by weight of the total amount of dispersant-thickening agent. For example, the cleaning amount of the dispersant thickening agent component may be about 30 ml. total. With six paint component containers 130*a*, 130*b*, 130*c*, 130*d*, 130*e* and 130*f*, the cleaning amount per cleaning squirt nozzle 99*a*, 99*b*, 99*c*, 99*d*, 99*e* and 99*f* may be about 5 ml.

Nozzles 118 dispense pre-selected amounts of paint components to make the desired paint followed by nozzles 99 which dispense the cleaning amount of dispersant thickening agent.

The pre-selected paint components flow through nozzles 118 followed by the cleaning amount of the dispersant-thickening agent through nozzles 99 removing residue from the production of the immediate aqueous paint composition before the next aqueous paint composition is produced at the point of sale.

As discussed above, desired paint 121 can be provided with a desired color by using color sample 122 and spectrophotometer 102 or by using a color data file. In the situation in which color sample 122 and spectrophotometer 102 are used, color sample 122 is held by sample holder 119 and spectrophotometer 102 flows colorant signal $S_{Colorant}$ to computer system 101 through cable 103. Computer system 101 receives signal $S_{Colorant}$ and determines the amount and color of the colorants needed to drive the color of the paint component combination contained by container 110 to match the color of color sample 122. The amount of paint colorants dispensed can be determined in many different ways, such as by volume and weight. In this embodiment, however, the colorants are dispensed by volume, as determined by colorant mass flow control system 112.

In response to the determination of the colorants, computer system 101 operates colorant mass flow control system 112 so that colorant storage system 104 flows the amount and color of colorants to dispenser 106 through plumbing system 128. The colorants are dispensed by colorant nozzle 127 into paint container 110 so that desired paint 121 is provided with a desired color. In this way, plumbing system 128 allows colorant components to flow between colorant storage system 104 and colorant nozzle 127 in response to an indication from computer system 101.

In the situation in which the color data file is used, the color data file is selected and it provides data to computer system 101 that corresponds to the desired color. The color data file can be selected using an input device such as monitor 101*a* and/of keyboard 10 lb. However, in accordance with the invention, the color data file can be selected using computer network 113. Colorant storage system 104 dispenses the colorants so, when combined with the paint components, the combination has a color driven to match the color represented by the color data file. Hence, the paint color indication can be provided to computer system 101 by selecting the color data file that corresponds with the desired color.

If desired, one or more additives can be added to the paint components, as discussed in more detail above. For example, in response to the paint additive indication, computer system 101 operates additive mass flow control system 132 so that additive storage system 134 flows the type and amount of additive(s) to dispenser 106 through additive plumbing system 138. The additive(s) are dispensed by additive nozzle 137 into paint container 110 so that desired paint 121 is provided with the desired additive(s). In this way, additive plumbing system 138 allows one or more additives to flow between additive storage system 134 and additive nozzle 137 in response to an indication from computer system 101.

In the situation in which the additive data file is used, the additive data file is selected and it provides data to computer system 101 which corresponds to the desired type and amount of additive(s) to be added to desired paint 121. The additive data file can be selected using an input device such as monitor 101*a* and/of keyboard 10 lb. However, in accordance with the invention, the additive data file can be selected using computer network 113. Additive storage system 134 dispenses the additive(s) so they are added to the paint components and combined therewith. Hence, the paint additive indication can be provided to computer system 101 by selecting the additive data file that corresponds with the desired type and amount of additive(s).

Figure 5A:
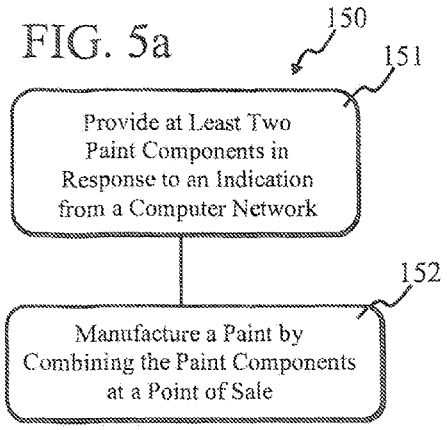
FIGS. 5*a*, 5*b*, 5*c*, 5*d* and 5*e* are block diagrams of a method, in accordance with the invention, of manufacturing a desired type of paint at a point of sale.

FIG. 5*a* is a block diagram of a method 150, in accordance with the invention, of manufacturing paint. In this embodiment, method 150 includes a step 151 of providing at least two paint components in response to an indication from a computer network, and a step 152 of manufacturing a paint by combining the paint components at a point of sale. In accordance with the invention, the paint components are provided by a paint manufacturing system. Further, the paint components are contained in separate paint component containers before they are combined. The paint components can be combined in many different ways, such as by mixing. In accordance with the invention, the paint components are selected from a group that includes a pigment composition, a dispersant thickening agent, and a resin content binder. It should be noted that the resin content binder can be a material with a high or low resin content, wherein the high resin content material includes more resin than the low resin content material. In one particular embodiment, the paint components include a resin content binder, and a pigment composition and/or dispersant thickening agent.

Figure 5B:
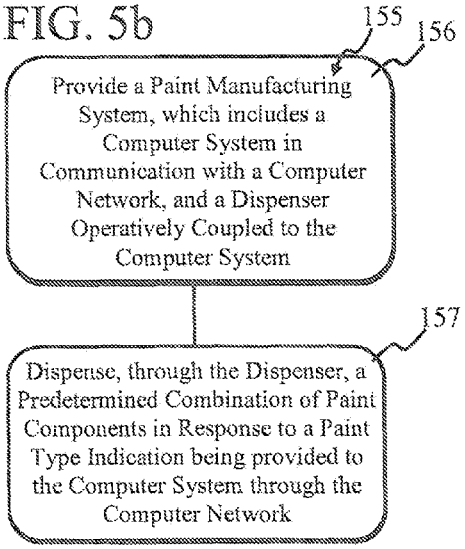

FIG. 5*b* is a block diagram of a method 155, in accordance with the invention, of manufacturing a desired type of paint. In this embodiment, method 155 includes a step 156 of providing a paint manufacturing system, which includes a computer system in communication with a computer network, and a dispenser operatively coupled to the computer system. It should be noted that the dispenser and computer system are typically located at the point of sale. Further, a portion of the computer network, such as an internet server, can be located at the point of sale.

Method 155 includes a step 157 of dispensing, through the dispenser, a predetermined combination of paint components in response to a paint type indication being provided to the computer system through the computer network. The desired paint is formed in response to the paint components being dispensed. The dispenser dispenses at least two paint components in response to the paint type indication. It should be noted that the paint components are dispensed at the point of sale.

Figure 5C:
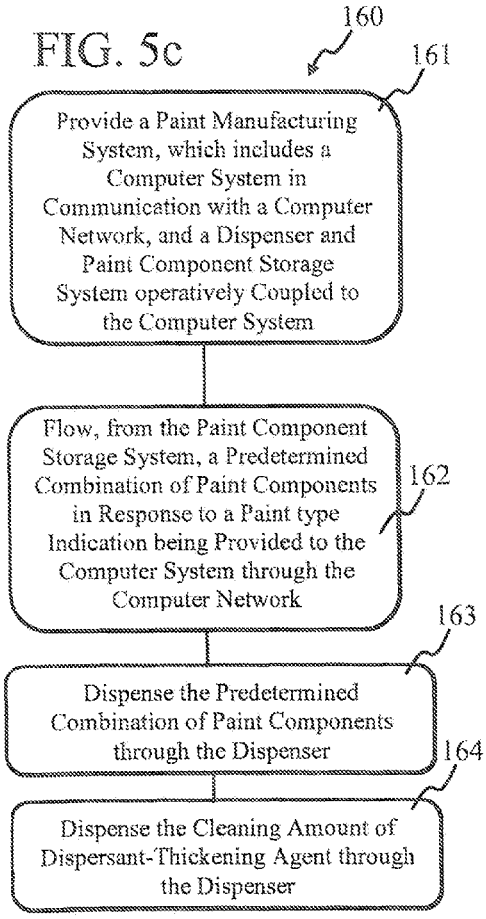

FIG. 5*c* is a block diagram of a method 160, in accordance with the invention, of manufacturing a desired type of paint. In this embodiment, method 160 includes a step 161 of providing a paint manufacturing system, which includes a computer system in communication with a computer network, and a dispenser and paint component storage system operatively coupled to the computer system. It should be noted that the computer system, dispenser and paint component storage system are typically located at the point of sale. Method 160 includes a step 162 of flowing, from the paint component storage system, a predetermined combination of paint components in response to a paint type indication being provided to the computer system through the computer network. Method 160 includes a step 163 of dispensing the predetermined combination of paint components through the dispenser. Method 160 includes a step 164 of dispensing the cleaning amount of dispersant-thickening agent through the dispenser. The desired paint is formed in response to the paint components being dispensed. The dispenser dispenses at least two paint components in response to the paint type indication.

Figure 5D:
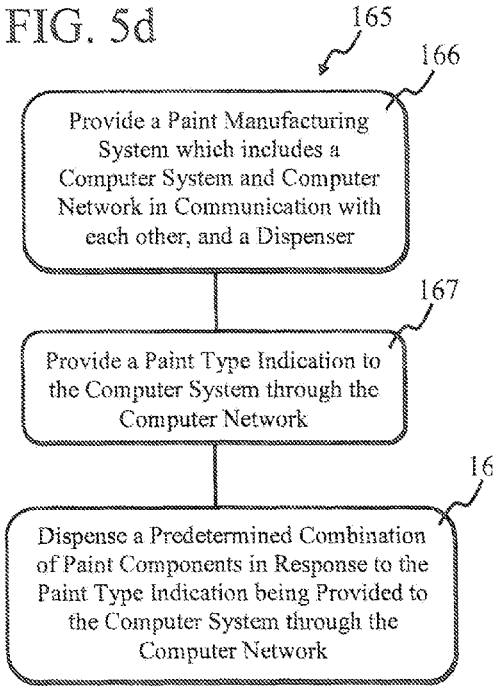

FIG. 5*d* is a block diagram of a method 165, in accordance with the invention, of manufacturing paint. In this embodiment, method 165 includes a step 166 of providing a paint manufacturing system which includes a computer system and computer network in communication with each other, and a dispenser. Method 165 includes a step 167 of providing a paint type indication to the computer system through the computer network. Method 165 includes a step 168 of dispensing a predetermined combination of paint components in response to the paint type indication being provided to the computer system through the computer network. The desired paint is formed at the point of sale in response to the paint components being dispensed.

In some embodiments, the paint manufacturing system of method 165 includes a colorant storage system operatively coupled to the computer system, wherein the colorant storage system is in fluid communication with the dispenser. In these embodiments, method 165 can include flowing a predetermined combination of colorants from the colorant storage system to the dispenser in response to a paint color indication. The paint color indication is provided to the computer system through the computer network. The colorants are dispensed by the dispenser and combined with the paint components.

In some embodiments, the paint manufacturing system of method 165 includes an additive storage system operatively coupled to the computer system, wherein the additive storage system is in fluid communication with the dispenser. In these embodiments, method 165 can include flowing a predetermined additive from the additive storage system to the dispenser in response to a paint additive indication. The paint additive indication is provided to the computer system through the computer network. The predetermined additive is dispensed by the dispenser and combined with the paint components.

Figure 5E:
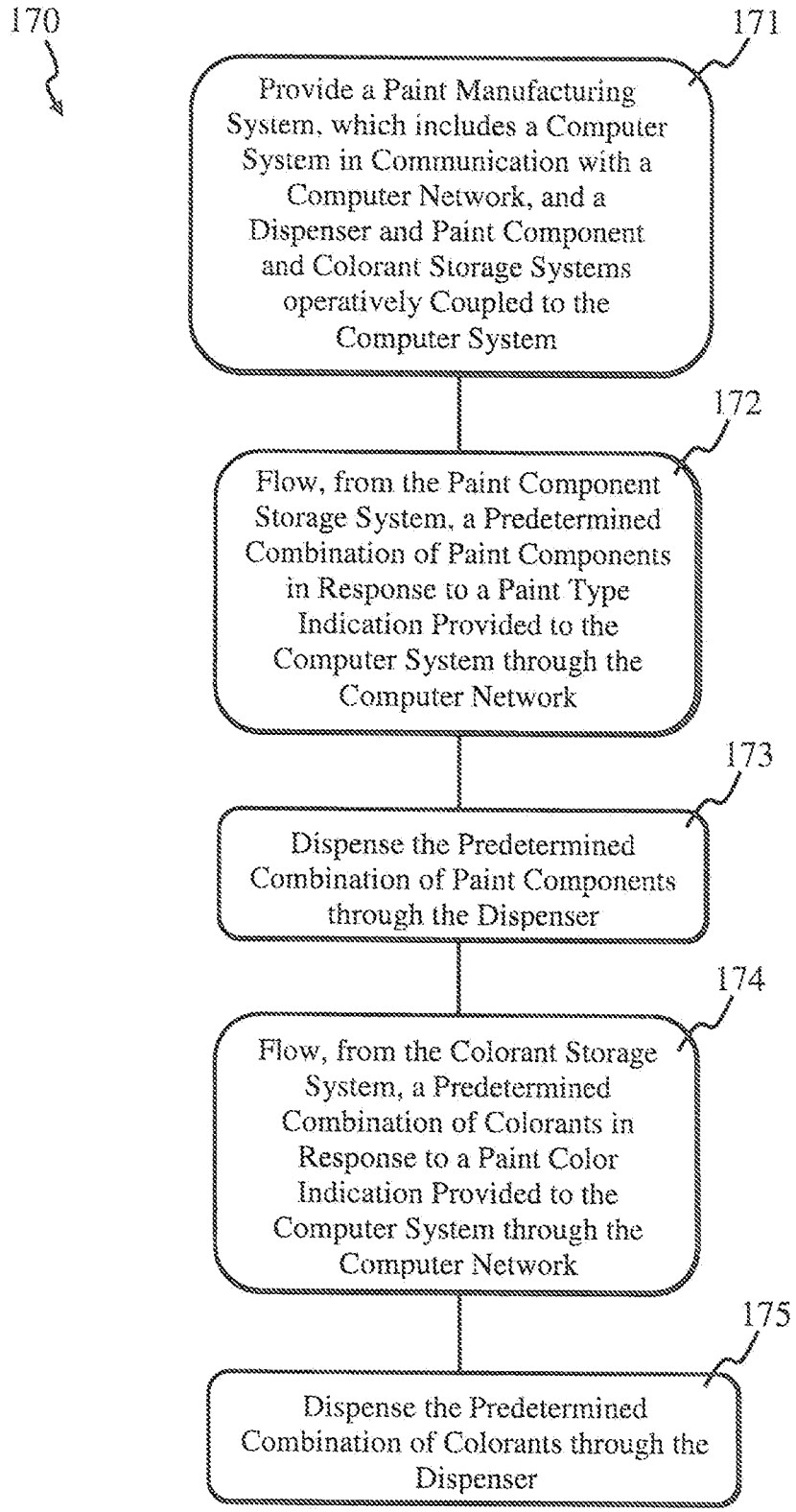

FIG. 5*e* is a block diagram of a method 170, in accordance with the invention, of manufacturing a desired type and color of paint. In this embodiment, method 170 includes a step 171 of providing a paint manufacturing system, which includes a computer system in communication with a computer network, and a dispenser and paint component and colorant storage systems operatively coupled to the computer system. It should be noted that the computer system, dispenser and paint component and colorant storage systems are typically located at the point of sale. Further, a portion of the computer network, such as an internet server, can be located at the point of sale.

Method 170 includes a step 172 of flowing, from the paint component storage system, a predetermined combination of paint components in response to a paint type indication being provided to the computer system through the computer network. Method 170 includes a step 173 of dispensing the predetermined combination of paint components through the dispenser. The desired paint is formed in response to the paint components being dispensed. The dispenser dispenses at least two paint components in response to the paint type indication. Method 170 includes a step 174 of flowing, from the colorant storage system, a predetermined combination of colorants in response to a paint color indication provided to the computer system through the computer network. Method 170 includes a step 175 of dispensing the predetermined combination of colorants through the dispenser. The colorants are combined with the paint components. The combination of colorants drives the color of the paint components to match the desired color.

In some embodiments, the paint manufacturing system of method 170 includes an additive storage system operatively coupled to the computer system, wherein the additive storage system is in fluid communication with the dispenser. In these embodiments, method 170 can include flowing a predetermined combination of additive(s) from the additive storage system to the dispenser in response to a paint additive indication. The paint additive indication is provided to the computer system through the computer network. The additive(s) are dispensed by the dispenser and combined with the paint components. It should be noted that the predetermined combination of additive(s) can be one or more additives.

Figure 6A:
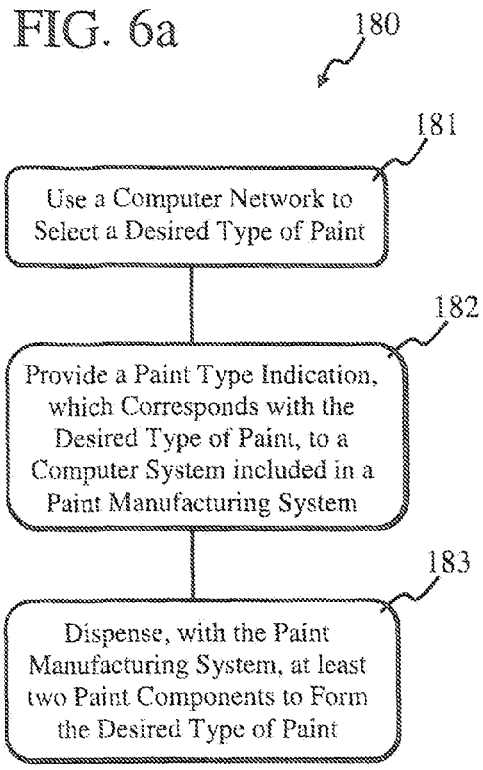
FIGS. 6*a*, 6*b*, 6*c*, 6*d* and 6*e* are block diagrams of a method, in accordance with the invention, of ordering a desired paint.

FIG. 6*a* is a block diagram of a method 180, in accordance with the invention, of ordering paint. In this embodiment, method 180 includes a step 181 of using a computer network to select a desired type of paint. The desired type of paint is generally selected using a web browser. Method 180 includes a step 182 of providing a paint type indication, which corresponds with the desired type of paint, to a computer system included in a paint manufacturing system. The paint type indication is provided by the computer network to the computer system through a communication link.

Method 180 includes a step 183 of dispensing, with the paint manufacturing system, at least two paint components to form the desired type of paint. The paint components are dispensed at the point of sale. The paint components are combined together, such as by mixing, at the point of sale. In accordance with the invention, the paint components are selected from a group that includes a pigment composition, a dispersant thickening agent, and a resin content binder. In one particular embodiment, the paint components include a resin content binder, and a pigment composition and/or dispersant thickening agent. In accordance with the invention, the paint components are contained in separate containers before they are combined together.

It should be noted that method 180 can include many other steps. For example, in some embodiments, method 180 includes a step of paying for the paint using the computer network. It should be noted, however, that the paint can be paid for at the point of sale, and in many other ways. Method 180 can also include a step of shipping the paint, such as to his or her house or business. It should be noted, however, that the paint can be picked-up at the point of sale. For example, the consumer can go to the point of sale and retrieve the paint.

Figure 6B:
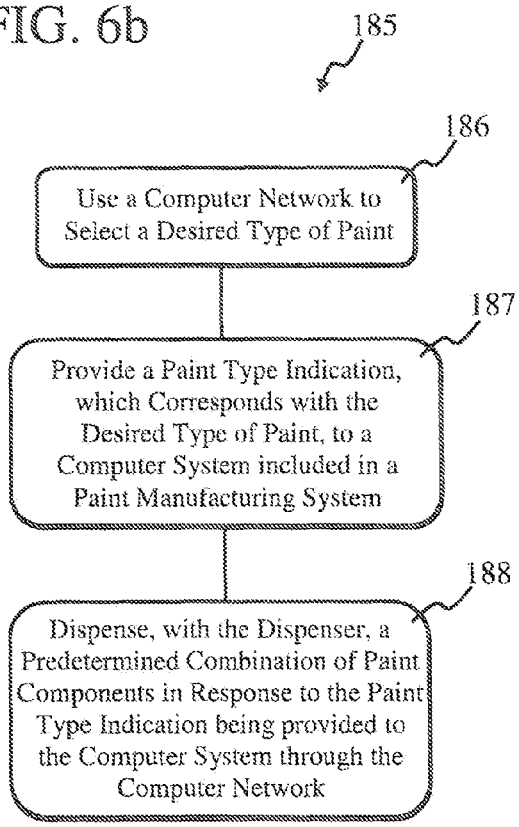

FIG. 6*b* is a block diagram of a method 185, in accordance with the invention, of ordering a desired type of paint. In this embodiment, method 185 includes a step 186 of using a computer network to select the desired type of paint. Method 185 includes a step 187 of providing a paint type indication, which corresponds with the desired type of paint, to a computer system included in a paint manufacturing system. In one embodiment, the paint type indication is provided to the computer system through the computer network. The paint manufacturing system also includes a dispenser operatively coupled to the computer system. It should be noted that the dispenser and computer system are typically located at the point of sale.

Method 185 includes a step 188 of dispensing, with the dispenser, a predetermined combination of paint components in response to the paint type indication being provided to the computer system through the computer network. The desired paint is formed in response to the paint components being dispensed. The dispenser dispenses at least two paint components in response to the paint type indication. It should be noted that the paint components are typically dispensed at the point of sale.

Figure 6C:
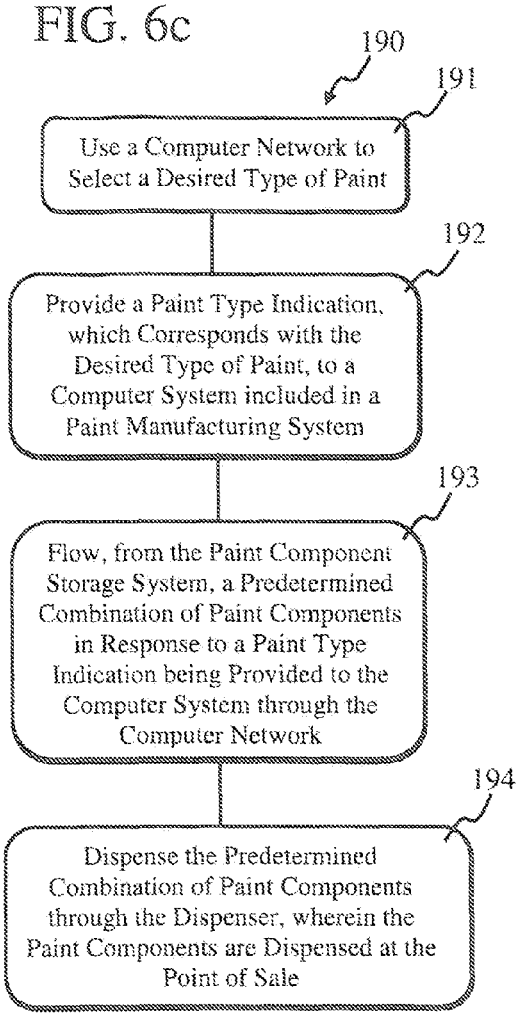

FIG. 6*c* is a block diagram of a method 190, in accordance with the invention, of ordering a desired type of paint. In this embodiment, method 190 includes a step 191 of using a computer network to select the desired type of paint. Method 190 includes a step 192 of providing a paint type indication, which corresponds with the desired type of paint, to a computer system included in a paint manufacturing system. The computer system is typically in communication with the computer network through a communication link. The paint manufacturing system also includes a dispenser and paint component storage system operatively coupled to the computer system. It should be noted that the computer system, dispenser and paint component storage system are typically located at the point of sale.

Method 190 includes a step 193 of flowing, from the paint component storage system, a predetermined combination of paint components in response to a paint type indication being provided to the computer system through the computer network. Method 190 includes a step 194 of dispensing the predetermined combination of paint components through the dispenser, wherein the paint components are dispensed at the point of sale.

Figure 6D:
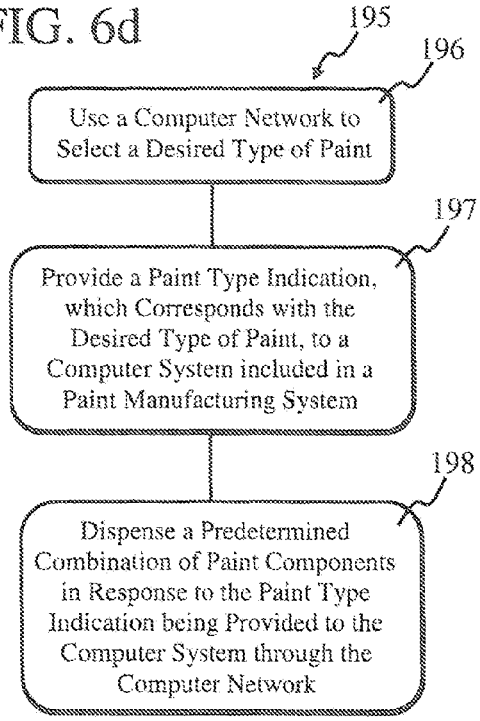

FIG. 6*d* is a block diagram of a method 195, in accordance with the invention, of ordering paint. In this embodiment, method 195 includes a step 196 of using a computer network to select the desired type of paint. Method 195 includes a step 197 of providing a paint type indication, which corresponds with the desired type of paint, to a computer system included in a paint manufacturing system. In this embodiment, the paint manufacturing system also includes a dispenser and a computer network in communication with the computer system. Method 195 includes a step 198 of dispensing a predetermined combination of paint components in response to the paint type indication being provided to the computer system through the computer network. The desired paint is formed in response to the paint components being dispensed.

In some embodiments, the paint manufacturing system of method 195 includes a colorant storage system operatively coupled to the computer system, wherein the colorant storage system is in fluid communication with the dispenser. In these embodiments, method 195 can include using the computer network to select a desired color of paint and a step of flowing a paint color indication to the computer system. In response to the paint color indication, a predetermined combination of colorants from the colorant storage system are flowed to the dispenser. The colorants are dispensed by the dispenser and combined with the paint components.

In some embodiments, the paint manufacturing system of method 195 includes an additive storage system operatively coupled to the computer system, wherein the additive storage system is in fluid communication with the dispenser. In these embodiments, method 195 can include flowing a predetermined additive from the additive storage system to the dispenser in response to a paint additive indication. The paint additive indication is provided to the computer system through the computer network. The predetermined additive is dispensed by the dispenser and combined with the paint components.

Figure 6E:
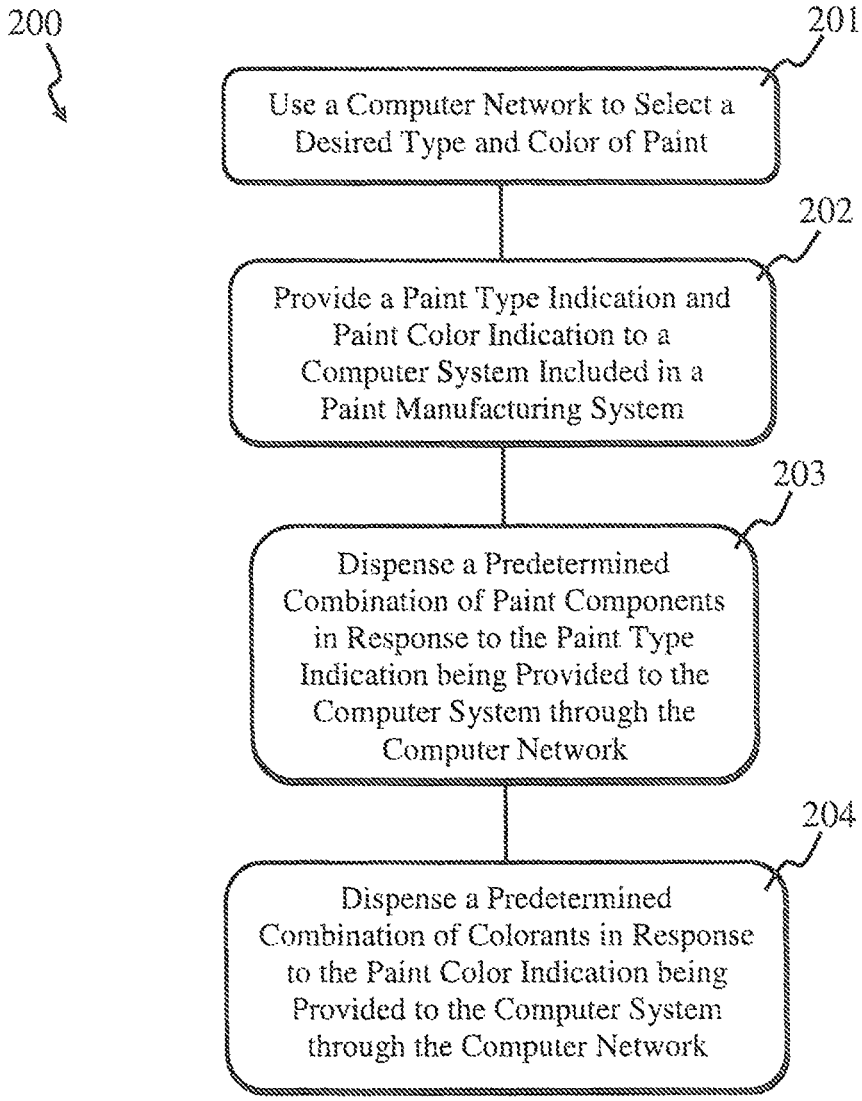

FIG. 6*e* is a block diagram of a method 200, in accordance with the invention, of ordering a desired type and color of paint. In this embodiment, method 200 includes a step 201 of using a computer network to select the desired type and color of paint. Method 200 includes a step 202 of providing a paint type indication and paint color indication to a computer system included in a paint manufacturing system. In accordance with the invention, the paint type and color indications are provided to the computer system through the computer network. The paint type indication corresponds with the desired type of paint and the paint color indication corresponds with the desired color of paint.

In this embodiment, the paint manufacturing system also includes a dispenser in fluid communication with the paint component and colorant storage systems. Further, the paint component and colorant storage systems are operatively coupled to the computer system. It should be noted that the computer system, dispenser and paint component and colorant storage systems are typically located at the point of sale. Further, a portion of the computer network, such as an internet server, can be located at the point of sale.

Method 200 includes a step 203 of dispensing a predetermined combination of paint components in response to the paint type indication being provided to the computer system through the computer network. The desired paint is formed in response to the paint components being dispensed. In step 203, the paint components are flowed from the paint component storage system to the dispenser in response to the paint type indication being provided to the computer system through the computer network.

Method 200 includes a step 204 of dispensing a predetermined combination of colorants in response to the paint color indication being provided to the computer system through the computer network. The colorants drive the color of the paint components to match the desired color. The colorants drive the color of the paint components to match the desired color when the colorants are combined with the paint components. In step 204, the colorants are flowed from the colorant storage system to the dispenser in response to the paint color indication being provided to the computer system through the computer network.

In some embodiments, the paint manufacturing system of method 200 includes an additive storage system operatively coupled to the computer system, wherein the additive storage system is in fluid communication with the dispenser. In these embodiments, method 200 can include flowing a predetermined combination of additive(s) from the additive storage system to the dispenser in response to a paint additive indication. The paint additive indication is provided to the computer system through the computer network. The additive(s) are dispensed by the dispenser and combined with the paint components. It should be noted that the predetermined combination of additive(s) can be one or more additives.

It should be noted that the steps in the methods discussed in FIGS. 5*a*-5*e* and 6*a*-6*e* can be carried out in many different orders other than the ones described here. Further, the steps in the different methods can be combined together in many ways. It should also be noted that, in any of the embodiments of the methods discussed in FIGS. 5*a*-5*e* and 6*a*-6*e*, the paint type and color indications can be provided to the computer system through an input device, such as a keyboard or touch-screen display. However, in accordance with the invention, the paint type and color indications are provided to the computer system through the computer network. In this way, the paint type and color indications are provided remotely.

While the invention has been particularly shown and described with reference to preferred embodiments thereof, it will be understood by those skilled in the art that various changes in form and details may be made therein without departing from the spirit and scope of the invention.

The invention claimed is:

1. A method for producing an aqueous paint composition comprising:

selecting a paint composition recipe through a user interface, wherein the paint composition recipe comprises a stable premixed aqueous dispersant-thickening agent composition;

computationally determining a cleaning amount of the dispersant-thickening agent composition and subtracting the cleaning amount of the dispersant-thickening agent composition from a total amount of the dispersant-thickening agent composition to equal a dispensing amount of the dispersant-thickening composition;

dispensing the dispensing amount of the dispersant-thickening agent composition with the paint composition recipe to a receiving reservoir; and then dispensing the cleaning amount of the dispersant-thickening agent composition to the receiving reservoir and agitating the receiving reservoir to produce the aqueous paint composition.

2. The method of claim 1, wherein the paint composition recipe further comprises at least two different stable premixed aqueous compositions selected from the group consisting of a stable pigment composition, a stable high resin composition, and/or a stable low resin composition.

3. The method of claim 1, wherein the cleaning amount is equal to or greater than the total amount of the dispersant-thickening agent composition and the dispensing amount of dispersant-thickening-agent composition is zero.

4. The method of claim 1, wherein the cleaning amount of the dispersant-thickening agent composition is dispensed following the dispensing of the dispensing amount of the dispersant-thickening agent composition with the paint composition recipe to a receiving reservoir.

5. The method of claim 1, wherein the cleaning amount of the dispersant-thickening agent composition is in the range of about 0.25% by weight to about 25% by weight of the total amount of dispersant-thickening agent composition.

6. The method of claim 1, wherein the cleaning amount of the dispersant thickening agent composition is about 30 ml.

7. The method of claim 1, wherein the cleaning amount of the dispersant-thickening agent composition and the dispensing amount of the dispersant-thickening agent composition are dispensed through separate nozzles.

8. The method of claim 7, wherein the cleaning amount of the dispersant-thickening agent composition is dispensed through a squirt nozzle.

9. The method of claim 8, wherein a number of squirt nozzles is equal to how many of the at least two different stable premixed aqueous compositions and the stable premixed aqueous dispersant-thickening agent composition are in the paint composition recipe.

10. The method of claim 9, wherein the cleaning amount of the dispersant-thickening agent composition is divided by the number of squirt nozzles dispensed equally through the number of squirt nozzles.

11. A paint manufacturing system comprising:

a point of sale having a computer system, wherein the computer system:

provides a user interface for selecting a paint composition recipe through the user interface, wherein the paint composition recipe comprises a stable premixed aqueous dispersant-thickening agent composition; and operates a program to computationally determine a cleaning amount of the dispersant-thickening agent composition and subtracting the cleaning amount of the dispersant-thickening agent composition from a total amount of the dispersant-thickening agent composition to equal a dispensing amount of the dispersant-thickening composition; and a dispenser, wherein the dispenser dispenses the dispensing amount of the dispersant-thickening agent composition with the paint composition recipe to a receiving reservoir; and then dispenses the cleaning amount of the dispersant-thickening agent composition to the receiving reservoir and agitating the receiving reservoir to produce the aqueous paint composition.

12. The system of claim 11, further comprising a paint storage system, wherein the dispenser dispenses the composition recipe from the paint storage system to the receiving reservoir.

13. The system of claim 11, wherein the paint composition recipe further comprises at least two different stable premixed aqueous compositions selected from the group consisting of a stable pigment composition, a stable high resin composition, and/or a stable low resin composition.

* * * * *